US008714735B2

(12) United States Patent
Kato et al.

(10) Patent No.: US 8,714,735 B2
(45) Date of Patent: May 6, 2014

(54) RECORDING APPARATUS

(75) Inventors: Shigeki Kato, Suwa (JP); Jun Yamada, Matsumoto (JP); Akihiro Toya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 140 days.

(21) Appl. No.: 13/422,851

(22) Filed: Mar. 16, 2012

(65) Prior Publication Data

US 2012/0236101 A1 Sep. 20, 2012

(30) Foreign Application Priority Data

Mar. 17, 2011 (JP) ..... 2011-059709
Mar. 18, 2011 (JP) ..... 2011-061416

(51) Int. Cl.
*B41J 2/01* (2006.01)

(52) U.S. Cl.
USPC ..... 347/104

(58) Field of Classification Search
USPC ..... 347/101, 104; 271/8.1; 101/494; 399/302, 304; 400/578, 642
IPC ..... B41J 2/01
See application file for complete search history.

(56) References Cited

U.S. PATENT DOCUMENTS

| | | | | |
|---|---|---|---|---|
| 6,921,163 | B2 | 7/2005 | Fujioka | |
| 7,137,750 | B2 | 11/2006 | Fujioka et al. | |
| 7,204,653 | B2 | 4/2007 | Fujioka et al. | |
| 2002/0067403 | A1 * | 6/2002 | Smith | 347/104 |
| 2003/0084811 | A1 * | 5/2003 | Ishii et al. | 101/494 |
| 2007/0176956 | A1 * | 8/2007 | Fujioka et al. | 347/16 |
| 2010/0149298 | A1 * | 6/2010 | Fujioka et al. | 347/104 |

FOREIGN PATENT DOCUMENTS

JP 2002-205855 7/2002

* cited by examiner

*Primary Examiner* — Manish S Shah
*Assistant Examiner* — Roger W Pisha II
(74) *Attorney, Agent, or Firm* — Workman Nydegger

(57) ABSTRACT

A recording apparatus includes: a platen in which first suction holes passing through from a medium support surface to a rear surface are formed; first pressure chambers provided to communicate with the first suction holes; a second pressure chamber disposed on the side opposite to the platen and communicating with the first pressure chambers; a wall section which is disposed between the first pressure chambers and the second pressure chamber and in which second suction holes each making the first pressure chamber and the second pressure chamber communicate with each other are formed; a suction mechanism which suctions rolled paper on the medium support surface through the first and second suction holes; and a slide plate movable in a parallel fashion along the wall section and provided with blocking portions having different lengths in a direction of parallel movement and capable of blocking the second suction holes.

9 Claims, 17 Drawing Sheets

RECORDING APPARATUS

This Application claims the benefit of Japanese Patent Application No. 2011-59709, filed on Mar. 17, 2011 and Japanese Patent Application No. 2011-61416, filed on Mar. 18, 2011, both of which are hereby incorporated by reference herein in its entirety.

BACKGROUND

1. Technical Field

The present invention relates to a recording apparatus.

2. Related Art

In a recording apparatus such as an ink jet printer, when performing a recording process on a recording medium such as recording paper, the recording medium needs to be supported by a platen in such a manner that the recording medium is in a certain position (parallel) with respect to a recording head.

Particularly, in a case where rolled paper is used as the recording medium, since the end portions of the rolled paper float from the platen due to rolling (curling), there is a recording apparatus which is provided with a paper suction section which suctions rolled paper to the platen in order to reduce floating.

The paper suction section is usually made so as to adsorb and retain (negative pressure suction) the rolled paper on the platen by providing a large number of suction holes in the platen and suctioning external air through each suction hole via a built-in fan on the rear surface side of the platen.

In the case of placing a recording medium, such as rolled paper, on the platen and transporting the medium, due to changes in the size (variations in the width direction dimension) of the recording medium, the transport state (position), or the like, the suction holes are not necessarily all covered by the recording medium. In other words, since there are suction holes in an opened state, which are not covered by the recording medium, air leaks from these suction holes (air leakage occurs).

Then, if there are a large number of suction holes in such an opened state, the adsorption force that adsorbs the recording medium is reduced, so that suppression of floating of the recording medium becomes incomplete.

For this reason, as shown in JP-A-2002-205855, a printer apparatus in which a shutter mechanism which opens and closes the large number of suction holes in a stepwise manner is provided on the rear surface side of a platen with a large number of suction holes formed therein and the shutter mechanism is operated in accordance with the transport state or the like of the recording medium is proposed.

In the invention disclosed in JP-A-2002-205855, a configuration is provided in which a flat plate-like shutter member disposed on the rear surface side of the platen is reciprocated by a cam mechanism. Then, the suction holes in the platen and the through holes in the shutter member are aligned and the area of the opening can be adjusted by altering the degree of overlap of the holes.

However, especially when applied to large-scaled printers, in the above-mentioned invention, there is a problem in that air leakage easily occurs. In order to suppress air leakage when the suction holes of the platen are closed by the shutter member, there is a need to bring the platen and the shutter member into close contact with each other. However, in large-scaled printers, since the areas of both the platen and the shutter member are large, the shutter member disposed on the rear surface side of the platen is prone to bending due to its own weight, so that it is not always easy to bring the two into close contact with each other.

Further, a structure to markedly suppress reductions in the adsorption force that adsorbs the recording medium in place has also been disclosed. This is achieved by providing a sheet covering the surface of the platen, thereby limiting the adsorption area in accordance with the width of the recording medium and blocking areas where the recording medium is not present from the surface side of the platen.

However, since a sheet is disposed covering the surface of the platen, the risk of collision or the like with a recording head should be avoided. Further, in the case of a structure in which the sheet is disposed on the pressure chamber side below the platen, thereby blocking the suction holes from the rear surface side of the platen, since rigidity and close contact are required for a structure section which partitions the suctioning area, there is a tradeoff between functionality and operability.

Further, since an existing shutter member is fabricated by performing sheet-metal working on a thin metal plate, the larger the size, the more difficult it becomes to attain flatness. If the flatness of the shutter member is low, close contact with the platen becomes poor, so that air leakage easily occurs from the suction holes.

SUMMARY

An advantage of some aspects of the invention is that it provides a recording apparatus in which it is possible to reliably suction and retain a recording medium and it is also possible to improve functionality and operability.

According to an aspect of the invention, there is provided a recording apparatus including: a medium support section in which a plurality of first suction holes that pass through from the medium support surface which supports a recording medium to the rear surface is formed; a recording process section which carries out a recording process on the recording medium; a plurality of first suction sections which are provided on the rear surface side and communicate with the plurality of first suction holes; a second suction section which is disposed on the side opposite the medium support section of the plurality of first suction sections; a wall section which is disposed between the first suction sections and the second suction section and in which a plurality of second suction holes which cause the respective first suction sections to communicate with the second suction sections is formed; a suction mechanism which suctions the recording medium disposed on the medium support surface through the first suction holes and the second suction holes; and a slide member disposed on the wall section, which is movable in a parallel fashion along the wall section, and is provided with a plurality of blocking portions having lengths different from each other in a direction of parallel movement and capable of selectively blocking the plurality of second suction holes.

Further, in the recording apparatus according to the above aspect, the slide member may be disposed on the wall section on the first suction section side, be movable in a parallel fashion along the wall section, and be provided with the plurality of blocking portions having different lengths in the direction of parallel movement and capable of selectively blocking the plurality of second suction holes.

Further, in the recording apparatus according to the above aspect, the slide member may have an area smaller than that of the medium support surface, be disposed parallel to the wall section on the rear surface side of the wall section, be movable in a parallel fashion along a direction crossing the transport direction of the recording medium, and be provided with the blocking portions having lengths different from each other in the direction of parallel movement and capable of selectively blocking the plurality of second suction holes.

According to the above configurations, when the second suction holes are not blocked by the blocking portions, air (external air) on the medium support surface can be suctioned through the first suction holes and the first suction sections. Then, if the slide member is moved in a parallel fashion along the wall section, the second suction hole is blocked by the blocking portion, so that air leakage from the second suction hole is suppressed. In other words, since by selectively blocking the second suction holes which are located in areas where the recording medium is not present, it becomes no longer possible to suction air on the medium support surface through the first suction hole corresponding to the second suction hole, and other first suction holes can carry out an effective suction action. In this way, the recording medium can be reliably suctioned to and retained on the medium support surface without reducing functionality and operability.

Further, in the recording apparatus according to the above aspect, the plurality of blocking portions may have sequentially different lengths in accordance with positions in the direction of parallel movement.

According to the above configuration, since it is possible to open and close the plurality of second suction holes in a stepwise manner in accordance with the amount of parallel movement of the sliding member, it is possible to exercise variable control over the suction amount by the suction mechanism in accordance with the width of the recording medium.

Further, in the recording apparatus according to the above aspect, a partition section which is disposed between the medium support section and the wall section and partitions the first suction sections adjacent to each other in the transport direction of the recording medium may be provided in a plurality.

According to the above configuration, since each first suction section communicates with at least one first suction hole, by selectively blocking the second suction hole which makes the plurality of first suction sections partitioned by the partition sections and the second suction section communicate with each other, air leakage from the first suction holes which are located in areas where the recording medium is not present is suppressed, so that it is possible to prevent a reduction in the adsorption force of the recording medium by the other first suction holes which are located in areas where the recording medium is present. In this way, the side portions of a recording medium of different width dimensions can be adsorbed to the medium support surface.

Further, in the recording apparatus according to the above aspect, a biasing section which biases the blocking portion to the wall section side may be provided.

According to the above configuration, since the slide member is always biased to the wall section side by the biasing section, a blocked state of the second suction hole can be maintained.

Further, in the recording apparatus according to the above aspect, at least the blocking portion may be formed by an elastic member.

According to the above configuration, since at least the blocking portion is formed by an elastic member, the slide member is elastically deformed so as to penetrate into the second suction hole, whereby the blocked state of the second suction hole can be more reliably maintained.

Further, in the recording apparatus according to the above aspect, the blocking portion may be incorporated in a state where the blocking portion is elastically deformed toward the wall section.

According to the above configuration, it is possible to maintain the blocked state of the second suction hole by the blocking portion.

Further, in the recording apparatus according to the above aspect, a hole row composed of the plurality of second suction holes arranged in the direction crossing the transport direction of the recording medium may be provided in a plurality in the transport direction, and the slide member may be provided for each hole row.

According to the above configuration, since the side portions of recording medium placed on the medium support surface can be adsorbed over a wide range along the transport direction, it is possible to keep a recording target area of the recording medium in a favorable position. Further, since it is possible to quickly apply negative pressure to the inside the first suction section through the plurality of second suction holes communicating with each first suction section, it becomes possible to quickly adsorb the recording medium placed on the medium support surface, thereby shortening recording process time.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment of the invention will be described with reference to the drawings. In addition, in each drawing which is used in the following explanation, in order to show each member at a recognizable size, the scale of each member is appropriately changed.

Figure 1:
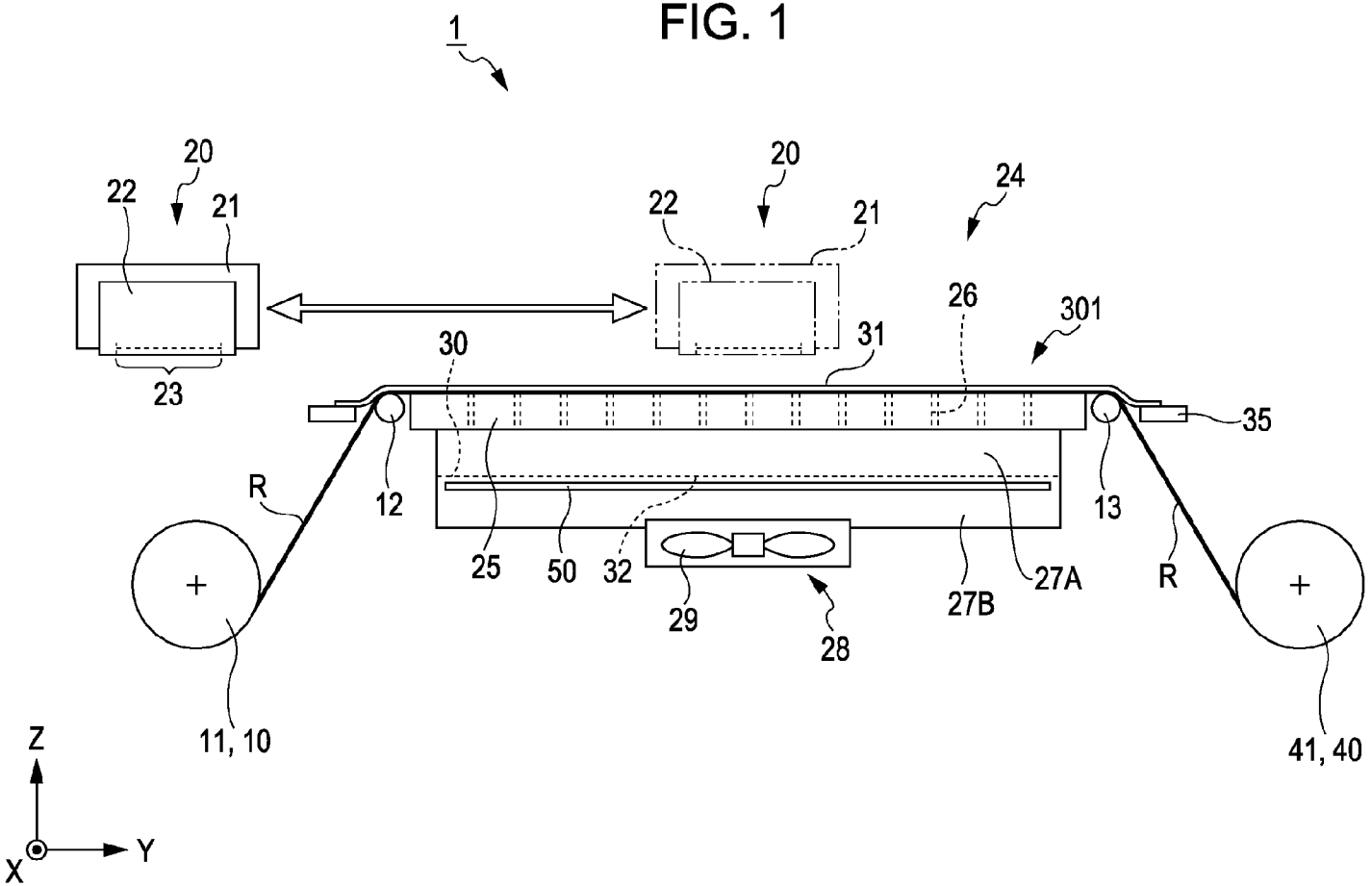
FIG. 1 is a side view showing the schematic configuration of an ink jet printer related to a first embodiment.

FIG. 1 is a side view showing the schematic configuration of an ink jet printer related to the first embodiment.

Figure 2:
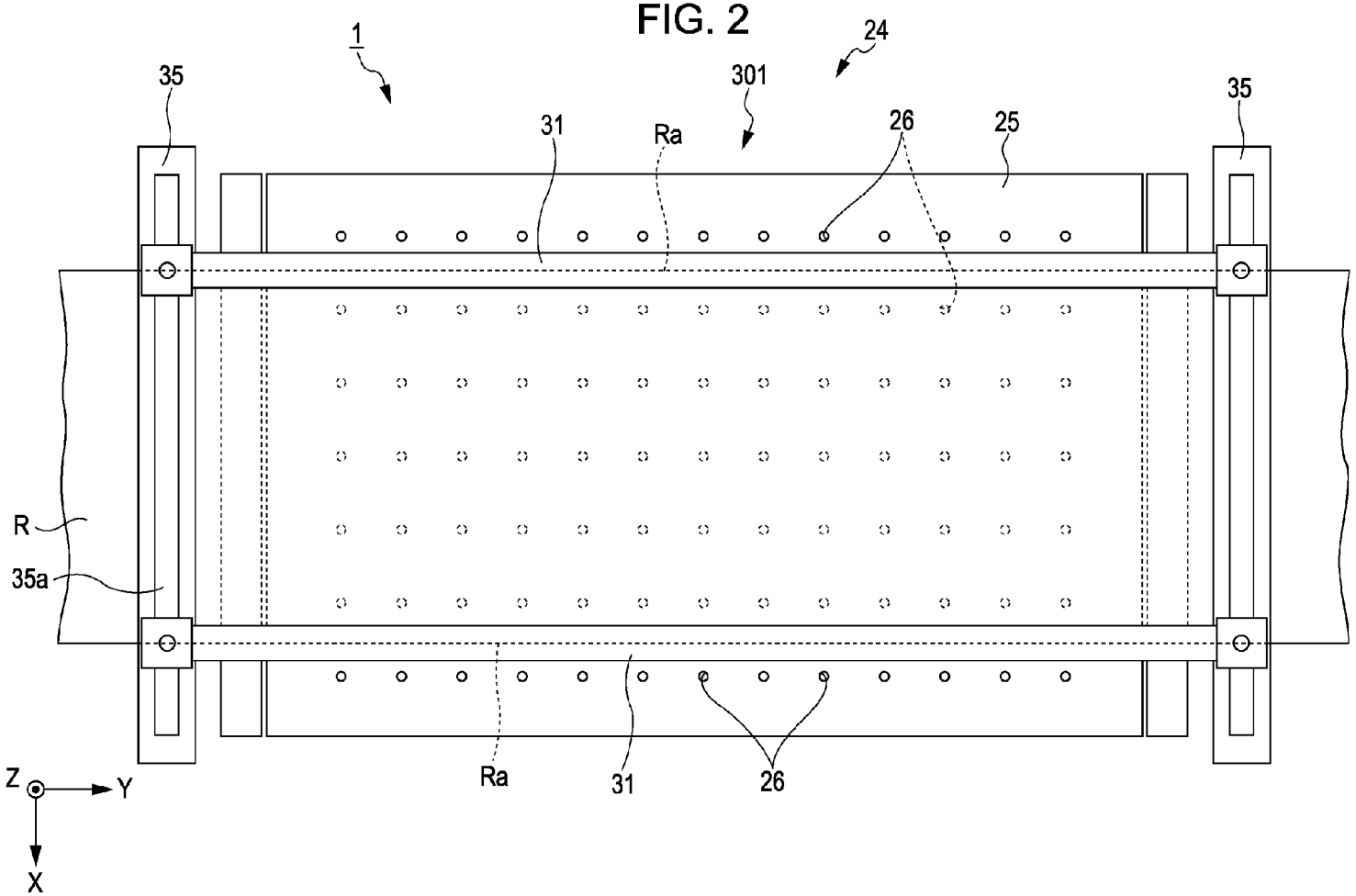
FIG. 2 is a top view showing the schematic configuration of the ink jet printer.

FIG. 2 is a top view showing the schematic configuration of the ink jet printer.

As shown in FIG. 1, an ink jet printer (a recording apparatus) 1 includes a feed section 10, a recording section (a recording process section) 20, and a discharge section 40.

The feed section (a medium transport section) 10 is provided so as to be able to feed rolled paper (a recording medium) R that is one example of a recording medium to the recording section 20. Specifically, the feed section 10 has a rolled medium holder 11 and the rolled medium holder 11 holds the rolled paper R with a roll shape. Then, a configuration is made such that by rotating the rolled paper R with a roll shape, it is possible to feed the rolled paper R in a state where the rolled state is released, to the recording section 20 on the downstream side in the transport direction (the direction of the arrow on the Y axis) through a first roller 12.

The recording section 20 is provided so as to be able to carry out recording by discharging ink that is one example of liquid onto the rolled paper R sent from the feed section 10.

Specifically, the recording section 20 includes a carriage 21, a recording head 22, a medium support table 24, a curl presser section 301, and the like.

The carriage 21 is provided so as to face the medium support table 24 and be able to move in a transport direction Y of the rolled paper R by the power of a carriage motor (not shown) while being guided by a second guide shaft (not shown).

In addition, in FIG. 1, a state is shown where the carriage 21 has retreated further to the upstream side in the transport direction than the medium support table 24.

Further, the recording head 22 is provided on the carriage 21, thereby being provided so as to be able to move together with the carriage 21 in the transport direction Y.

Further, the recording head 22 is configured so as to be able to move relative to the carriage 21 in a width direction X. Specifically, the recording head 22 is provided so as to be able to move in the width direction X by the power of a recording head motor (not shown) while being guided by a second guide shaft (not shown).

In other words, the recording head 22 is configured so as to be able to move in a Y direction (a sub-scanning direction) that is the transport direction and an X direction (a main scanning direction) that is the width direction, in a range which faces the medium support table 24.

Then, recording can be carried out on the rolled paper R by discharging ink from a nozzle row 23 provided in the surface facing the medium support table 24 of the recording head 22.

The medium support table (a medium suction and support device) 24 is provided so as to be able to support the rolled paper R from the rear surface side of the rolled paper R. The medium support table 24 is provided with a platen (a medium support section) 25 having a medium support surface 25*a* which supports the rolled paper R, a pressure chamber forming body 45 which forms a plurality of pressure chambers 27A and a pressure chamber 27B, and a suction mechanism 28 which applies negative pressure to the pressure chambers 27A and 27B.

As shown in FIGS. 1 and 2, in the platen 25, suction holes (first suction holes) 26, each of which is for example, formed of a through-hole having an inner diameter of the order of several mm, are formed over almost the entirety of the medium support surface 25*a* which supports the rolled paper R. Specifically, the suction holes 26 each having an inner diameter in a range of 2 mm to 3 mm are formed to be arranged in the Y direction (the transport direction of the rolled paper R) that is the longitudinal direction of the platen 25 and the X direction (the width direction of the rolled paper R) that is the width direction.

The inside of the pressure chamber forming body 45 has a so-called double floor structure which has a wall section 30 disposed spaced apart from the platen 25 and in a parallel fashion, and is disposed on the rear surface side of the platen 25. The pressure chamber forming body 45 has the plurality of pressure chambers (first suction sections) 27A and the pressure chamber (a second suction section) 27B which is a lower layer of the plurality of pressure chambers 27A and is disposed on the rear surface side of the wall section 30, and has a configuration in which the plurality of pressure chambers 27A is stacked on the pressure chamber 27B which is large relative to the pressure chamber 27A.

The plurality of pressure chambers 27A is arranged side by side in a direction (the paper width direction) crossing the transport direction of the rolled paper R, and the pressure chambers 27A adjacent to each other in the same direction are partitioned by a partition section 33 disposed between the platen 25 and the wall section 30 and also connected to both of them.

The partition section 33 is for partitioning a space which is formed between the platen 25 and the wall section 30, and a plurality of partition sections 33 is provided in an erect manner on the wall section 30. The plurality of partition sections 33 is disposed at given intervals along the width direction of the rolled paper R and the upper end side of each partition section 33 is connected to the rear surface of the platen 25.

In addition, the plurality of partition sections 33 may also be formed integrally with the wall section 30 and may also be provided as separate bodies from the wall section 30.

Each partition section 33 is a plate member extending in the transport direction of the rolled paper R and is disposed so as to be located between the suction holes 26 adjacent to each other in the paper width direction among the plurality of suction holes 26 formed in the platen 25.

The plurality of pressure chambers 27A communicates with the pressure chamber 27B through a plurality of suction holes (second suction holes) 32 formed in the wall section 30. The suction holes 32 are formed one-to-one with the suction holes 26 formed in the platen 25 and provided corresponding to each pressure chamber 27A in the bottom of each pressure chamber 27A. A space in each pressure chamber 27A and a space in the pressure chamber 27B communicate with each other through the suction holes 32.

Each of the plurality of pressure chambers 27A is a small-sized enclosed space in which a top surface is formed by the platen 25 and a bottom surface is formed by the wall section 30, and the pressure chamber 27B is a large-sized enclosed space in which a top surface is formed by the bottoms of the plurality of pressure chambers 27A, that is, the wall section 30. Then, the suction mechanism 28 is connected to the pressure chamber forming body 45 so as to be connected to the bottom of the pressure chamber 27B (the bottom of the pressure chamber forming body 45). In addition, the suction mechanism 28 may also be connected to the pressure chamber forming body 45 so as to be connected to a side wall of the pressure chamber 27B.

In the inside of the pressure chamber forming body 45, a shutter mechanism 50 capable of selectively opening and closing the plurality of suction holes 32 formed in the wall section 30 is provided. The configuration or the like of the shutter mechanism 50 will be described later.

The suction mechanism 28 is for suctioning air in the pressure chambers 27A and 27B which are in the state of communicating with each other through the suction holes 32, thereby making the inside of each space have negative pressure. Specifically, the suction mechanism 28 is configured so as to suction air in the pressure chambers 27A and 27B by an axial-flow fan 29. In this way, external air is suctioned through the plurality of suction holes 26 formed in the platen 25, so that the rolled paper R placed on the platen 25 is adsorbed to the medium support surface 25*a*.

The curl presser section 301 is for pressing the side ends Ra of the rolled paper R placed on the platen 25 toward the medium support surface 25*a*, thereby preventing so-called floating in which the side ends Ra of the rolled paper R are curled and separated from the platen 25.

Specifically, the curl presser section 301 is provided with a pair of curl presser members 31 each formed of a strip-shaped film having pliability and flexibility. The respective curl presser members 31 are disposed over all areas in the Y direction (the transport direction of the rolled paper R) on both end sides in the X direction of the platen 25 (both ends in the width direction of the rolled paper R).

In addition, each curl presser member 31, for example, has a thickness of 0.5 mm or less and a width of about 30 mm. Further, as a material thereof, for example, polyimide or the like can be used.

Both ends (end portions in the Y direction) of each curl presser member 31 are respectively connected to curl presser mounting sections 35. Each of the curl presser mounting sections 35 is a member having a length approximately equal to the length in the width direction (the X direction) of the platen 25 and is fixed to a base section (not shown) of the ink jet printer 1 along the width direction at a position spaced apart from an end portion in the longitudinal direction (the Y direction) of the platen 25.

Further, both ends of the curl presser member 31 are respectively connected to the curl presser mounting sections 35 so as to be able to move along the X direction. In this way, each curl presser member 31 is disposed in a parallel fashion in the longitudinal direction (the Y direction) of the platen 25 at an arbitrary position in the width direction (the X direction) of the platen 25 by moving both ends thereof along the curl presser mounting sections 35.

Therefore, it becomes possible to press both ends in the width direction (the X direction) of the rolled paper R placed on the upper surface of the platen 25 over the entire area in the longitudinal direction (the Y direction).

The discharge section 40 is configured so as to have a take-up roller 41 and wind the rolled paper R sent from the recording section 20 on the take-up roller 41.

In addition, the discharge section 40 is sometimes provided with a tensioner which eliminates the flexure of the rolled paper R when the rolled paper R sent from the recording section 20 is wound by the take-up roller 41, or a drying section which performs a heating and drying treatment on the rolled paper R sent from the recording section 20.

Next, the configuration of the shutter mechanism 50 provided in the medium support table 24 will be described in detail.

Figure 3A:
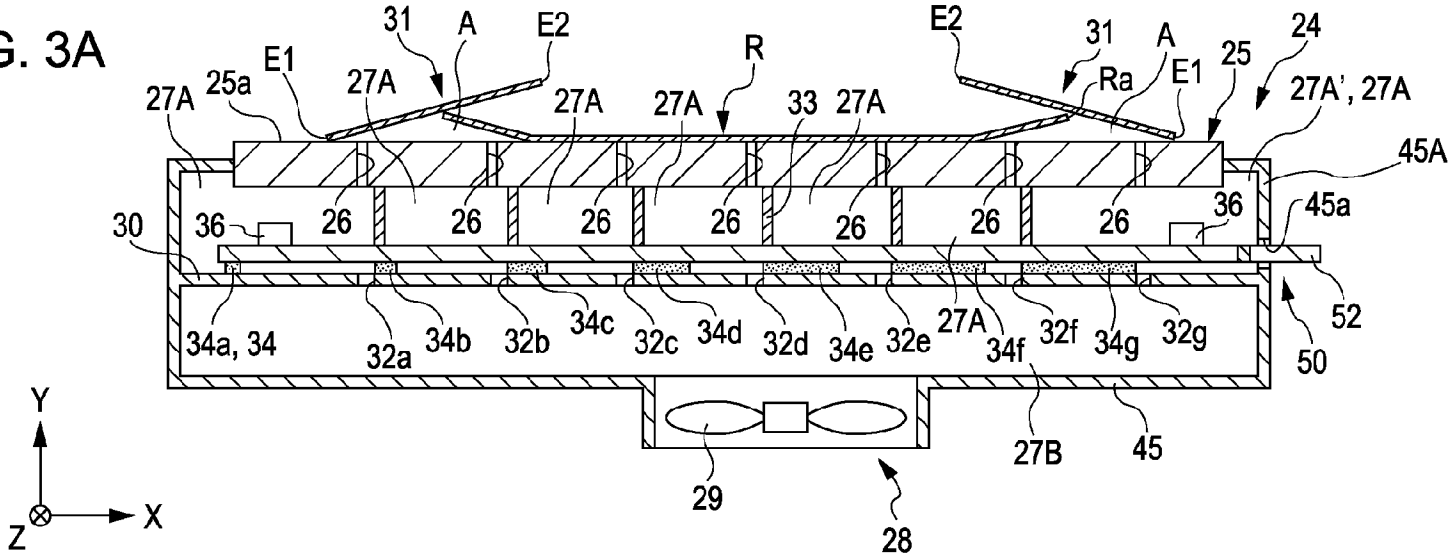
FIG. 3A is a cross-sectional view schematically showing the configurations of a suction mechanism and a shutter mechanism.
Figure 3B:
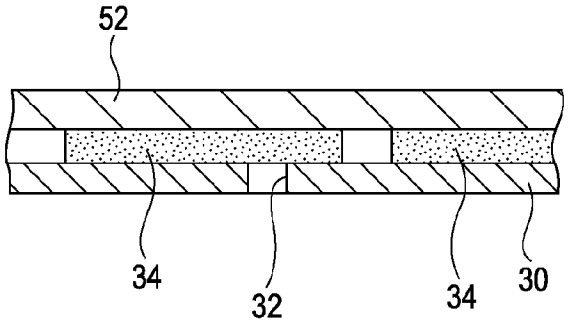
FIG. 3B is an enlarged fragmentary cross-sectional view showing a main section of the shutter mechanism.
Figure 4:
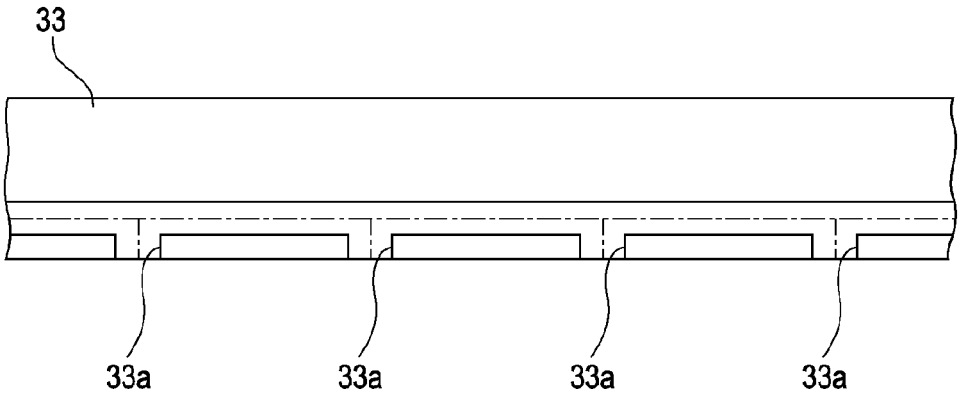
FIG. 4 is a side view schematically showing the configuration of a partition section.
Figure 5:
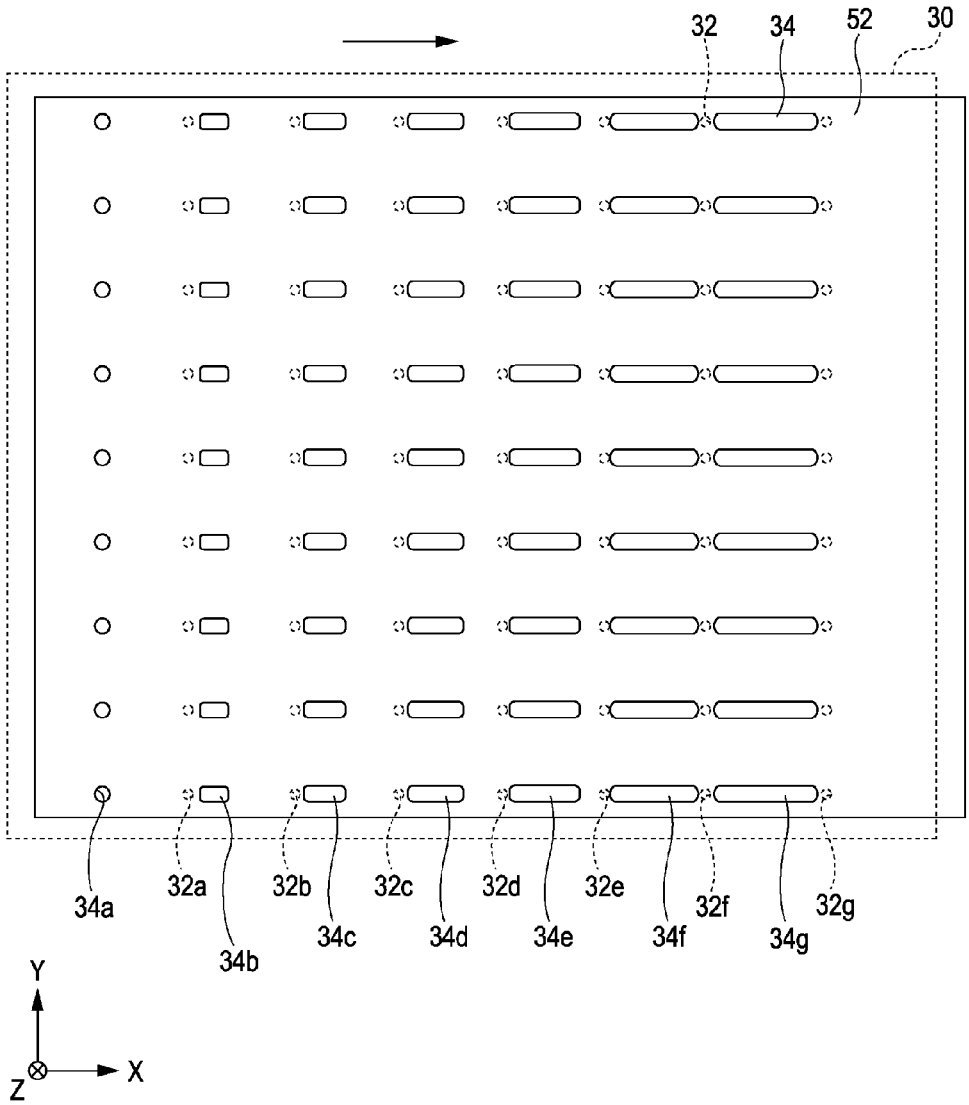
FIG. 5 is a plan view schematically showing a positional relationship between the shutter mechanism and a wall section.

FIG. 3A is a cross-sectional view schematically showing the configurations of the suction mechanism and the shutter mechanism, and FIG. 3B is an enlarged fragmentary cross-sectional view showing a main section of the shutter mechanism. FIG. 4 is a side view schematically showing the configuration of the partition section. FIG. 5 is a plan view schematically showing a positional relationship between the shutter mechanism and the wall section.

The shutter mechanism 50 can selectively open and close the large number of suction holes 32 formed in the wall section 30, in accordance with a change in the size (a change in the width dimension) of the rolled paper R, as described above, and selectively applies negative pressure to the large number of suction holes 26 formed in the platen 25 to cause adsorption force action.

As shown in FIGS. 3A and 3B, the shutter mechanism 50 is constituted by a slide plate (a slide member) 52 disposed spaced apart from and parallel to the rear surface of the platen 25, blocking portions 34 provided one-to-one with the suction holes 32 which penetrate the wall section 30 in the thickness direction, and a biasing section 36.

Planar Shape of Slide Plate

On the slide plate 52, a large number of blocking portions 34 are formed at positions respectively corresponding to the large number of suction holes 32 formed in the wall section 30. In other words, as shown in FIG. 5, if the slide plate 52 and the wall section 30 are viewed from above in the initial state, the blocking portions 34 disposed on the slide plate 52 are arranged and formed in a row so as to overlap the suction holes 32 of the wall section 30 on a one-to-one basis.

The slide plate 52 is configured so as to be able to manually or automatically move in a parallel fashion in the X direction (the width direction of each of the platen 25 and the rolled paper R) in a state where the slide plate 52 is disposed spaced apart from and parallel to the rear surface of the platen 25. Specifically, the slide plate 52 is made so as to be able to move in a parallel fashion and in a stepwise manner at a given interval (pitch) in the +X direction. For example, the slide plate 52 is made so as to be able to move in a parallel fashion and in a stepwise manner at an interval (a pitch) of 6 mm, thereby moving in a parallel fashion to a position of 6 mm, 12 mm, 18 mm, 24 mm, 30 mm, or the like from the initial position shown in FIGS. 3A and 5 toward the X direction.

In this embodiment, since the slide plate 52 is moved in a parallel fashion, in order to make the movement load small, it is preferable to set the thickness of the slide plate 52 to be the order of several mm. Further, as a material of the slide plate 52, stainless steel or the like is suitable. The slide plate 52 is always biased to the wall section 30 side by the biasing section 36 provided on the surface side of the slide plate 52. The biasing section 36 is constituted by an elastic member such as a leaf spring or a coil member and a single or a plurality of slide plates 52 is provided on the upper surface side of the slide plate 52.

It is preferable that the blocking portion 34 have a height (thickness) of the order of several mm and be formed by an elastic member such as rubber, sponge which it is difficult for air to pass through, a resin material, or the like. As will be described later, by moving the slide plate 52 in a parallel fashion, thereby disposing the blocking portion 34 corresponding to a given suction hole 32 to face the given suction hole 32, it is possible to selectively block the suction holes 32. Here, since the slide plate 52 is always biased to the wall section 30 side by the biasing section 36, the flexible blocking portion 34 disposed on the suction hole 32 is elastically deformed so as to penetrate into the suction hole 32, so that a blocked state of the suction hole 32 can be maintained.

In addition, a major portion of the shutter mechanism 50 is almost accommodated in the plurality of pressure chambers 27A. However, in order for the slide plate 52 to move in a parallel fashion in the X direction along the platen 25, openings 33*a* which make the slide plate 52 and the blocking portions 34 be inserted therein and pass therethrough are respectively provided in the respective partition sections 33 arranged in one direction. Further, an opening 45*a* is also provided in a side wall of a pressure chamber 27A' (the pressure chamber 27A) which is located furthest in the direction (the +X direction) of movement of the slide plate 52, that is, a side wall 45A of the pressure chamber forming body 45, so that one end portion of the slide plate 52 is disposed so as to protrude outside the pressure chamber forming body 45.

Specifically, in the openings 33*a* (FIG. 4) provided in the plurality of partition sections 33 and the opening 45*a* provided in the side wall 45A of the pressure chamber forming body 45, airtight mechanisms (not shown) are provided such that there is no air leakage. Then, a configuration is made such that the slide plate 52 can be moved in a parallel fashion toward the +X direction by inserting the slide plate 52 from the opening 45*a* of the pressure chamber forming body 45 into the openings 33*a* of the respective partition sections 33 and drawing out the slide plate 52 from the opening 45*a*.

Further, each of the plurality of blocking portions 34 is formed in an oblong shape or a rectangular shape along the X direction. The lengths in the extending directions of the respective blocking portions 34 are different from each other in accordance with the disposition positions of the blocking portions 34 in the X direction (the width direction of each of the platen 25 and the rolled paper R).

Specifically, a blocking portion 34*a* (the blocking portion 34) disposed on one side (the −X direction side) in the direction of movement of the slide plate 52 is formed in an approximately circular shape in a plan view. A blocking portion 34*b* adjacent to the blocking portion 34*a* in the X direction is formed in an oblong shape extending in the +X direction. Further, a blocking portion 34*c*, a blocking portion 34*d*, a blocking portion 34*e*, a blocking portion 34*f*, a blocking portion 34*g*, and the like are formed such that only the dimensions of long axes thereof become longer in a stepwise manner as it goes toward the +X direction.

For example, in a case where the dimension of a long axis of the blocking portion 34*a* is 6 mm, the dimension of a long axis of the blocking portion 34*b* is 12 mm, the dimension of a long axis of the blocking portion 34*c* is 18 mm, the dimension of a long axis of the blocking portion 34*d* is 24 mm, the dimension of a long axis of the blocking portion 34*e* is 30 mm, the dimension of a long axis of the blocking portion 34*g* is 34 mm, and so on.

On the other hand, the lengths in the width directions (the Y direction) of the plurality of blocking portions 34 are constant and each for example are 6 mm. The length in the width direction is formed so as to be larger than the diameter (4 mm) of each suction hole 32. This is because the suction hole 32 corresponding to each blocking portion 34 is blocked by the blocking portion 34, as will be described later.

Further, a chamfering treatment is carried out on an inner peripheral edge of each suction hole 32. Since in particular, the inner peripheral edge on the pressure chamber 27A side of the suction hole 32 comes into contact with the blocking portion 34 and are rubbed against the blocking portion 34, as will be described later, it is preferable to carry out various low-friction treatments other than the chamfering treatment.

In addition, the number, the shapes, or the like of the suction holes 32 or the blocking portions 34 is not limited to that shown and can be changed.

Next, an operation of the shutter mechanism 50 having the above-described configuration will be described.

In a state shown in FIGS. 3A and 5, that is, the initial state of the shutter mechanism 50 (the initial position of the slide plate 52), the plurality of suction holes 32 formed in the wall section 30 all remain opened, so that the pressure chambers 27A and 27B communicate with each other through the plurality of suction holes 32.

In this initial state, the suction mechanism 28 connected to the pressure chamber 27B of the medium support table 24 is driven, so that the axial-flow fan 29 is rotated, thereby applying negative pressure to the inside of the pressure chamber 27B. Then, the insides of the pressure chambers 27A enter negative pressure states through the respective suction holes 32 of the wall section 30, so that air (external air) on the upper surface side of the medium support table 24 is suctioned through all the suction holes 26 formed in the platen 25. In this way, the rolled paper R placed on the upper surface of the medium support table 24 (the medium support surface 25*a* of the platen 25) can be adsorbed to the medium support surface 25*a* of the platen 25.

In more detail, an operation is performed as shown in the following.

Figure 6:
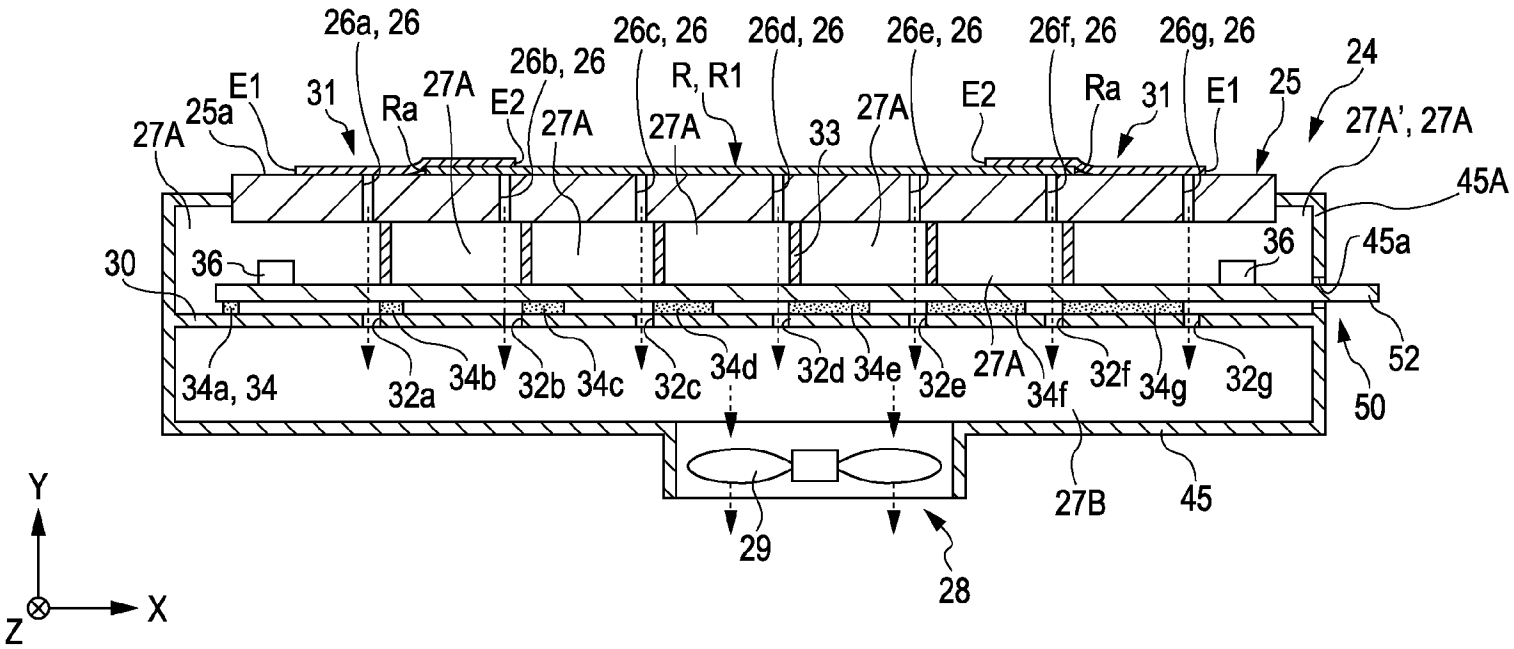
FIG. 6 is a schematic front cross-sectional view showing an action when the suction mechanism of a medium support table is driven.

FIG. 6 is a schematic front cross-sectional view showing an action when the suction mechanism of the medium support table is driven.

In addition, in FIGS. 3A and 6, a case is shown where the width dimension (the length in the X direction) of rolled paper (the recording medium) R1 is approximately equal to the width dimension of the platen 25.

As shown in FIG. 3A, in a state where the rolled paper R has been sent onto the platen 25, an operator fits the positions of the pair of curl presser members 31 in the X direction to positions facing the side ends Ra of the rolled paper R1, thereby placing each curl presser member 31 on each side end Ra of the rolled paper R1.

At this time, an outer end E1 of each curl presser member 31 is disposed so as to be located further at the outside than the side end Ra of the rolled paper R1 and is brought into contact with the platen 25. On the other hand, an inner end E2 of each curl presser member 31 is disposed so as to be located further at the inside than the side end Ra of the rolled paper R and is brought into contact with the side end Ra of the rolled paper R1.

Since a force pressing the rolled paper R1 to the platen 25 side acts on the pair of curl presser members 31, it is possible to bring the outer ends E1 of the pair of curl presser members 31 into at least line contact with the platen 25 and also to bring the inner ends E2 of the pair of curl presser members 31 into contact with the side ends Ra of the rolled paper R.

Then, as described above, the plurality of suction holes 26 are provided at least in areas facing the side ends Ra of the rolled paper R1 and the curl presser members 31 in the medium support surface 25*a* of the platen 25. Therefore, by driving the suction mechanism 28, air in spaces A each surrounded by the platen 25, the rolled paper R1, and the curl presser member 31 is suctioned through the suction holes 26.

Therefore, as shown in FIG. 6, the rolled paper R1 and the pair of curl presser members 31 enter states where they come into close contact with the platen 25. In other words, the rolled paper R1 and the pair of curl presser members 31 enter states where they are adsorbed to the medium support table 24.

In this way, the rolled paper R1 can be adsorbed in a planar state along the medium support surface 25*a* of the platen 25 (the upper surface of the medium support table 24).

Next, a case will be described where in place of the rolled paper R1, rolled paper (the recording medium) R2 which has a width dimension that is narrower (length in the X direction is shorter) than that of the rolled paper R1 is adsorbed to the medium support table 24.

Figure 7A:
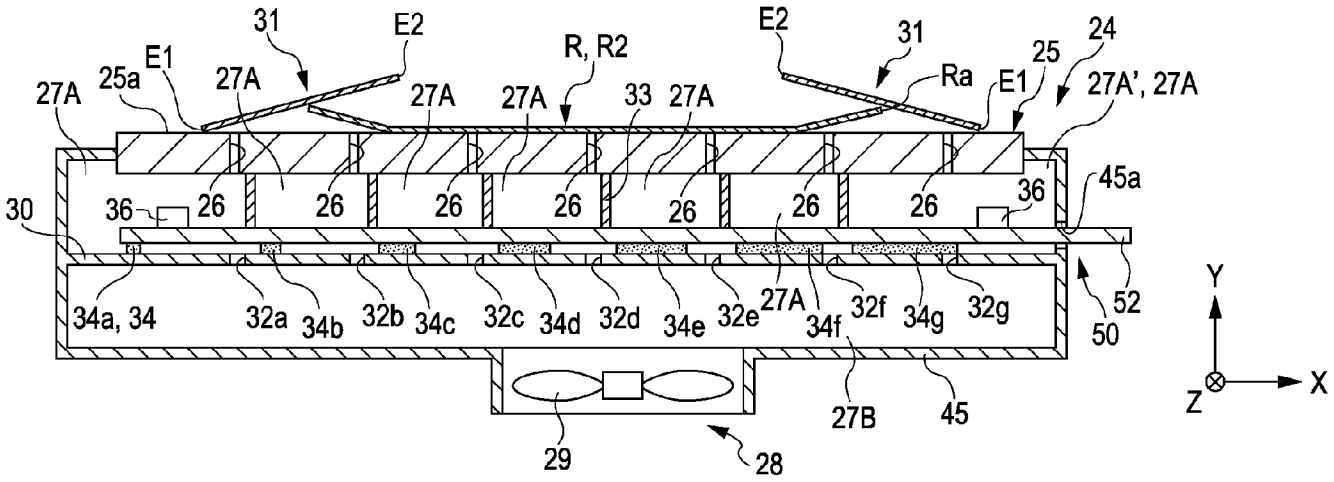
FIGS. 7A and 7B are schematic cross-sectional views showing a case where a slide plate is moved by one step from the initial position toward an X direction.
Figure 7B:
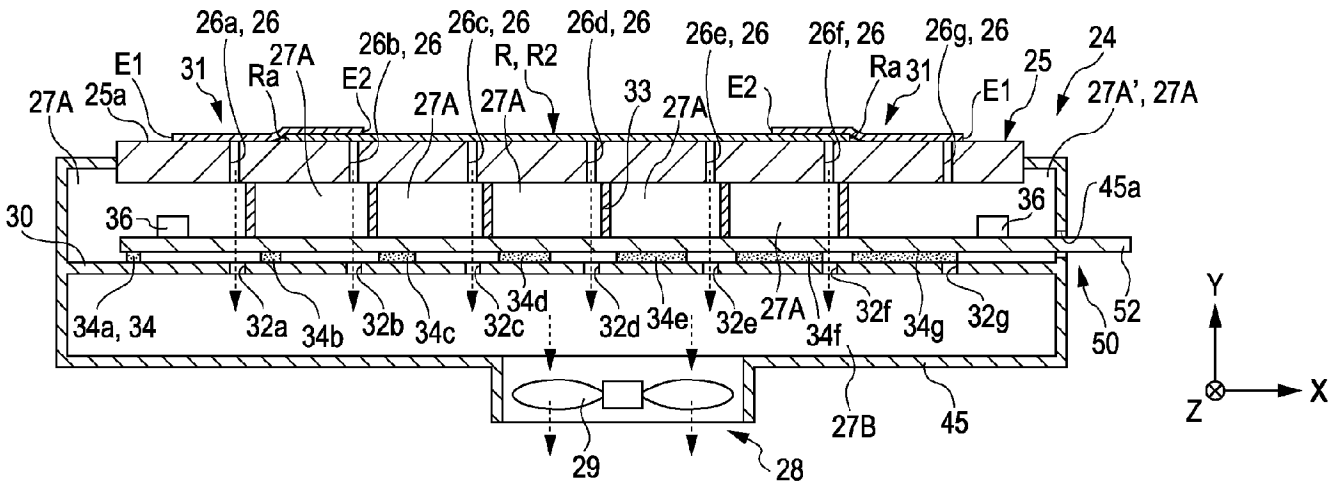

FIGS. 7A and 7B are schematic cross-sectional views showing a case where the slide plate 52 is moved by one step from the initial position toward the X direction.

For example, the width dimension of the rolled paper R2 is set to be narrower than that of the rolled paper R1 by an amount corresponding to a disposition pitch (one pitch) of the suction hole 26 in the X direction. When placing the rolled paper R2 on the medium support surface 25*a* of the platen 25, the rolled paper R2 is placed by so-called one-side matching (based on the end portion).

In a case where the width dimension of the rolled paper R2 placed on the platen 25 is narrower than that of the rolled paper R1, in advance of driving the suction mechanism 28, an operator moves the slide plate 52 in a parallel fashion from the initial position (refer to FIG. 3A) toward the +X direction.

In the case of the rolled paper R2, since the width dimension is narrower than that of the rolled paper R1 by an amount corresponding to a disposition pitch (one pitch) of the suction hole 26 in the X direction, the slide plate 52 is moved by one step (6 mm) from the initial position toward the +X direction.

As described above, in the initial state of the shutter mechanism 50 (the initial state of the slide plate 52), all the suction holes 32 provided in the wall section 30 are in opened states.

If the slide plate 52 is moved by 6 mm from this initial position toward the +X direction, as shown in FIG. 7A, the blocking portion 34*g* provided on the slide plate 52 faces a suction hole 32*g* and a portion thereof penetrates into the suction hole 32*g* due to a biasing force applied by the biasing section 36, so that an opening is blocked.

In this way, the suction hole 32*g* is blocked by the blocking portion 34*g*. Accordingly, even if the suction mechanism 28 is driven, air in the pressure chamber 27A' is not suctioned through the suction hole 32*g*, and furthermore, it becomes no longer possible to suction external air through the suction hole 26 of the platen 25, which communicates with the pressure chamber 27A'.

Further, at the same time as the movement of the slide plate 52 in the +X direction, one of the curl presser members 31 is moved in the +X direction, thereby being fitted to a position facing the side end Ra of the rolled paper R2.

Then, by driving the suction mechanism 28, the rolled paper R2 enters a state where it is adsorbed to the medium support table 24, as shown in FIG. 7B.

At this time, a state is created where the rolled paper R2 and the curl presser member 31 are not present above a suction hole 26*g* disposed furthest in the +X direction among the large number of suction holes 26 formed in the platen 25. For this reason, in an existing medium support table 24, if the suction mechanism 28 is driven, since external air is always suctioned from the suction hole 26*g*, the adsorption forces of the other suction holes 26*b* to 26*f* and the like are reduced, so that there is a case where it is not possible adsorb the rolled paper R2 to the medium support table 24.

In contrast, in the medium support table 24 in this embodiment, since the outermost (in the +X direction) suction hole 32*g* is blocked by the blocking portion 34*g* by moving the slide plate 52 in the +X direction, suctioning of external air through the suction hole 32*g* is mostly prevented. Therefore, the adsorption forces of the other suction holes 26 (26*a* to 26*f*) are not reduced. In this way, even in the case of the rolled paper R2 having a width dimension narrower than that of the rolled paper R1, the rolled paper R2 can be adsorbed to the upper surface of the medium support table 24 (the medium support surface 25*a* of the platen 25) by a adsorption force approximately equal to that in the case of the rolled paper R1.

Further, in a case where rolled paper or the like, in which a width dimension is narrower (length in the X direction is shorter) than those of the rolled paper R1 and R2, is adsorbed to the medium support table 24, an operator moves the slide plate 52 and the curl presser members 31 in a parallel fashion toward the X direction in accordance with the width dimension of the rolled paper.

In this manner, even in the case of adsorbing the rolled paper R (R2) having a different width dimension, it is possible to maintain a adsorption force approximately equal to that in the case of the rolled paper R1 and adsorb the rolled paper R (R2) to the upper surface of the medium support table 24.

As described above, according to the ink jet printer 1 related to this embodiment, in a state where all the suction holes 32 of the wall section 30 provided on the rear surface side of the platen 25 and disposed between the plurality of pressure chambers 27A and the corresponding pressure chamber 27B are opened, external air is suctioned from all the suction holes 26, so that it is possible adsorb the rolled paper R1.

Then, in a case where the rolled paper is replaced with rolled paper (for example, the rolled paper R2) having a different width dimension, by moving the slide plate 52 in a parallel fashion with respect to the wall section 30, the suction hole 32 corresponding to the suction hole 26 on which the rolled paper is not placed is selectively blocked by the blocking portion 34, and suctioning is performed in this state.

For example, in a case where the number of the suction mechanism 28 is one, if an area where suction power is generated is not controlled in accordance with the width dimension of the rolled paper R, a problem arises in that suction power to the rolled paper R is reduced.

In contrast, according to the configuration of this embodiment, by selectively blocking the suction hole 32 which is located in an area where the rolled paper R is not present, it becomes no longer possible to suction air on the medium support surface 25*a* through the suction hole 26 corresponding to the suction hole 32. For this reason, it is possible to make suction power effectively act on the suction holes 26 which are located in areas where the rolled paper R is present. Therefore, since suction power to the rolled paper R can be sufficiently obtained, even the rolled paper R having a different width dimension can be reliably adsorbed on the medium support surface 25*a*.

Further, the shutter mechanism 50 in this embodiment is provided with the slide plate 52 configured to have a size (an area) covering all the suction holes 32 formed in the wall section 30. Even though the slide plate 52 is of a large size, by installing it on the upper surface side of the wall section 30, flexure due to its own weight is suppressed, so that it becomes easy to secure close contact between the blocking portion 34 and the suction hole 32. In this way, it is possible to selectively and efficiently block the plurality of suction holes 32 provided in the wall section 30, without reducing functionality and operability as a shutter mechanism.

Further, since the direction of parallel movement of the slide plate 52 corresponds with the width direction of the rolled paper R, it is possible to selectively open and close the plurality of suction holes 32 in accordance with a change in the width dimension of the rolled paper. In other words, since the lengths of the plurality of blocking portions 34 arranged in the direction of movement of the slide plate 52 are sequentially different in accordance with the disposition positions thereof in the direction of movement of the slide plate 52, it is possible to selectively open and close the plurality of suction holes 32 in a stepwise manner in accordance with the amount of parallel movement of the slide plate 52. Accordingly, it becomes possible to variably control the suction amount (output) of the suction mechanism 28 in accordance with the width dimension of the rolled paper R.

Further, since a configuration is made such that the extending lengths of the blocking portions 34 are different in a stepwise manner along the direction of movement of the slide plate 52, it is possible to minimize the movement distance of the slide plate 52. For this reason, it is also possible to minimize installation area of the apparatus.

Further, in this embodiment, since the slide plate 52 is in a state where it is always biased to the wall section 30 side by the biasing section 36, close contact of the blocking portion 34 with the suction hole 32 is increased, so that air leakage from the suction hole 32 can be prevented and the suction hole 32 can be reliably blocked.

Further, by carrying out the treatment of reducing friction against the blocking portion 34 of the slide plate 52, such as chamfering work on the inner circumferential surface of the suction hole 32, it is possible to suppress air leakage at the time of blocking of the suction hole 32 over a long period of time.

Further, a chemical treatment may also be carried out on the surface of the blocking portion 34 or the upper surface of the wall section 30 so as to reduce frictional resistance thereof.

Further, in this embodiment, a configuration is taken in which a single suction hole 26 communicates with a single pressure chamber 27A. However, a configuration may also be taken in which a plurality of suction holes 26 communicates with a single pressure chamber 27A.

Figure 8A:
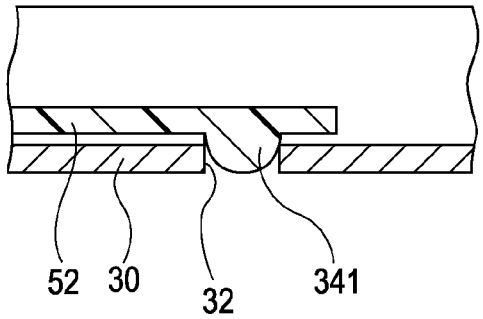
FIGS. 8A and 8B are cross-sectional views showing modified examples of a blocking portion.
Figure 8B:
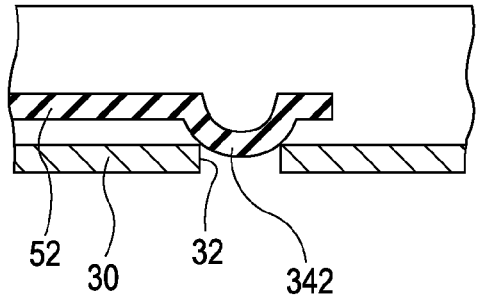

FIGS. 8A and 8B show modified examples of the blocking portion.

For example, as shown in FIG. 8A, the slide plate 52 having a blocking portion 341 formed of a resin material and exhibiting a hemispherical shape is also acceptable, and as shown in FIG. 8B, the slide plate 52 having a convex blocking portion 342 formed of rubber, film, or the like is also acceptable.

Next, another embodiment of the shutter mechanism will be described.

Figure 9A:
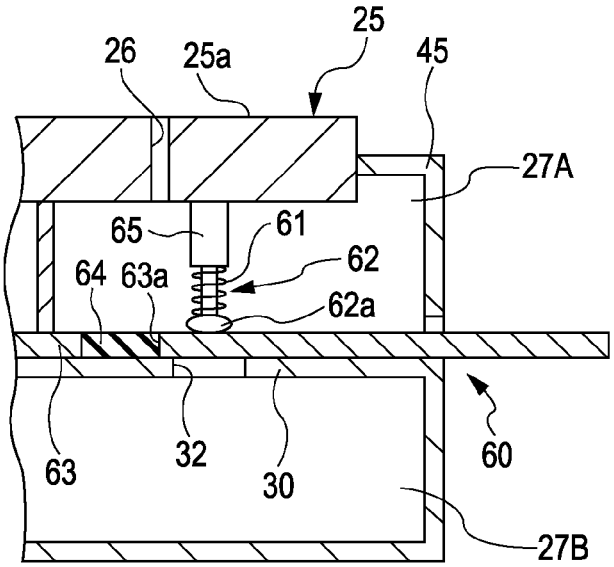
FIGS. 9A and 9B are cross-sectional views schematically showing the configuration of a shutter mechanism related to another embodiment.
Figure 9B:
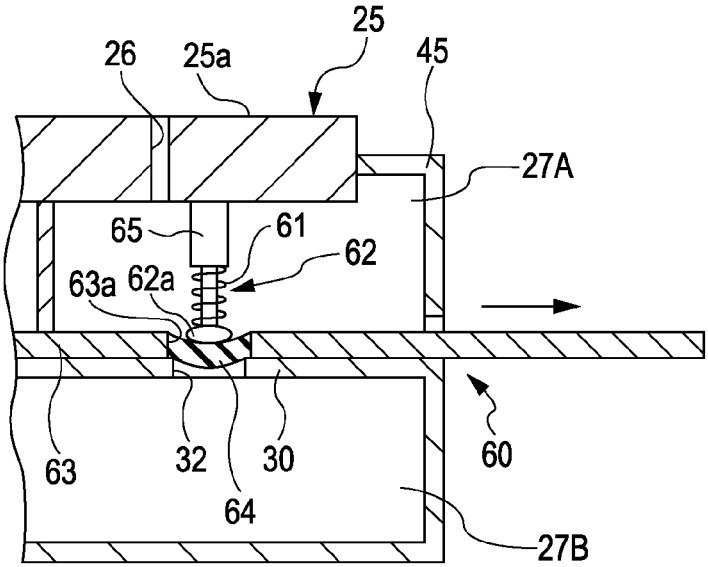

FIGS. 9A and 9B are cross-sectional views schematically showing the configuration of a shutter mechanism related to another embodiment. In addition, the same member or the like as that in the shutter mechanism 50 described above is denoted by the same reference numeral and explanation thereof is omitted, and different members or the like will be mainly described.

A shutter mechanism 60 shown in FIG. 9A is configured to have a pressing section 62 disposed at a position facing the suction hole 32 of the wall section 30, and a slide plate 63 disposed between the pressing section 62 and the wall section 30 and movable in a parallel fashion along the wall section 30. The slide plate 63 is constituted using, for example, a mesh plate or the like as a base material and made so as to make the suction hole 26 formed in the platen 25 and the suction hole 32 communicate with each other and also to be able to block the suction hole 32 by a blocking portion 64 provided corresponding to the suction hole 32. The blocking portion 64 is formed by an elastic member such as rubber so as to have a thickness approximately equal to the thickness of the base material and disposed in a plurality of through-holes 63*a* which penetrate the base material in the thickness direction.

Then, a head portion 62*a* of the pressing section 62 movable with respect to a base section 65 is always biased to the wall section 30 side by a biasing section 61. For this reason, if the blocking portion 64 is disposed directly below the pressing section 62 to face the pressing section 62 by sliding the slide plate 63, the blocking portion 64 is deformed so as to be extruded into the suction hole 32 by the pressing section 62, so that the suction hole 32 is blocked. Even in such a configuration, the same effects as those in the above-described embodiment can be obtained, so that the suction hole 32 of the wall section 30 can be blocked by the blocking portion 62.

In addition, in the embodiments described above, the rolled paper R has been given and described as one example of the recording medium. However, single sheet paper or a film material is also acceptable.

Further, the number of axial-flow fans 29 of the suction mechanism 28 is not limited to one and a plurality of axial-flow fans may also be provided.

Second Embodiment

Hereinafter, a second embodiment of the invention will be described with reference to the drawings. In addition, in each drawing which is used in the following explanation, in order to show each member at a recognizable size, the scale of each member is appropriately changed.

Figure 10:
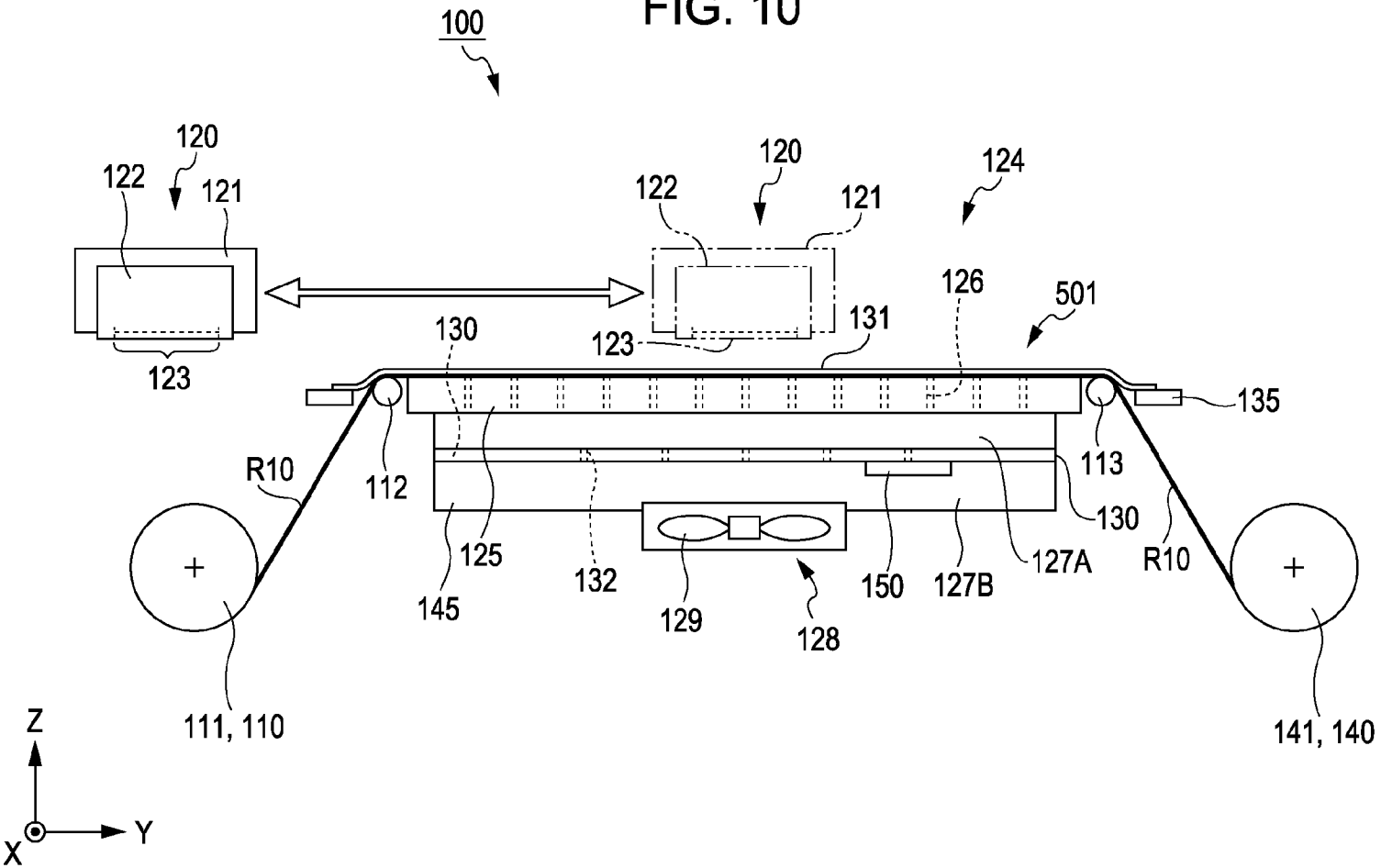
FIG. 10 is a side view showing the schematic configuration of an ink jet printer related to a second embodiment.
Figure 11:
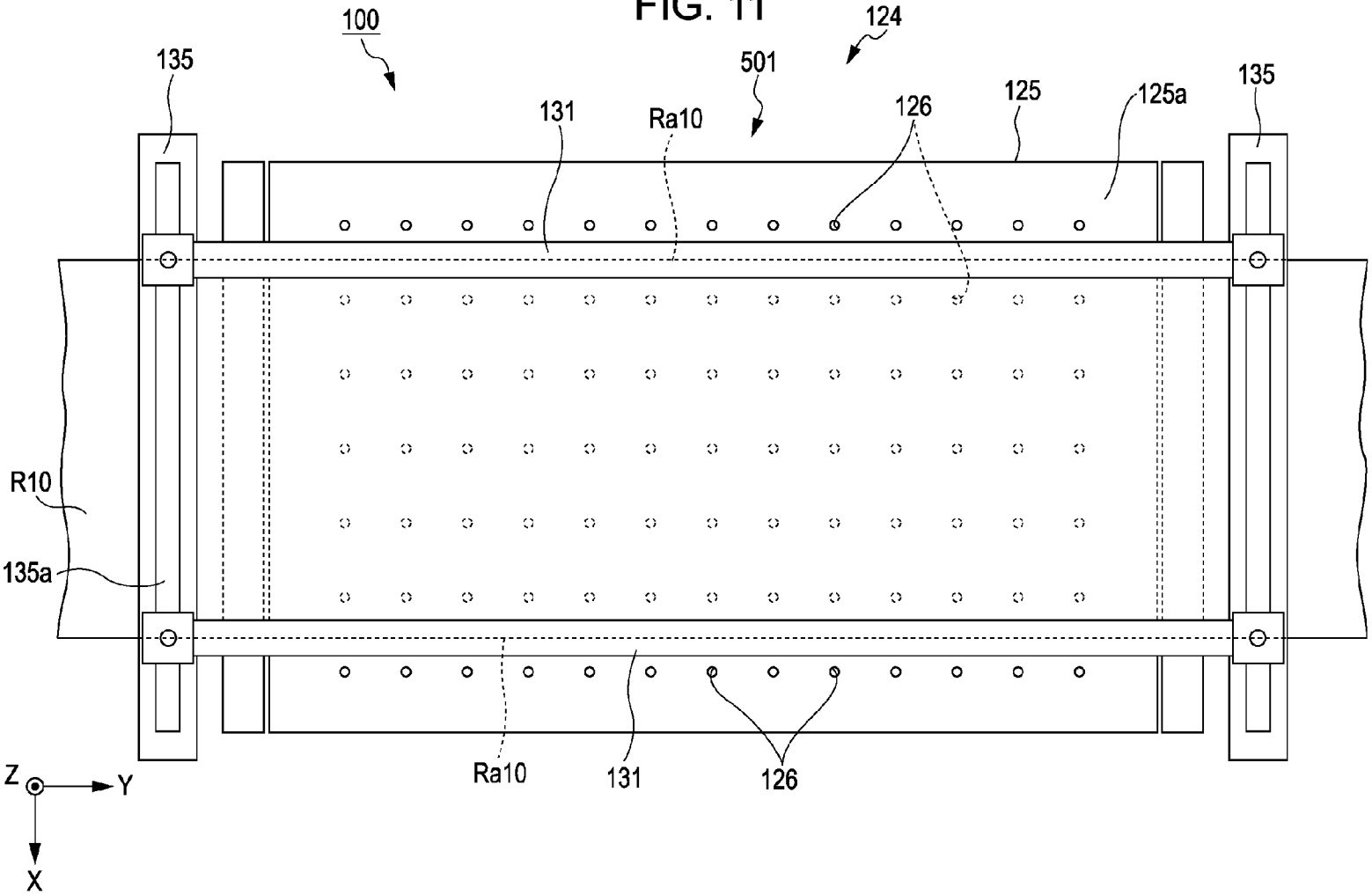
FIG. 11 is a top view showing the schematic configuration of the ink jet printer.
Figure 12:
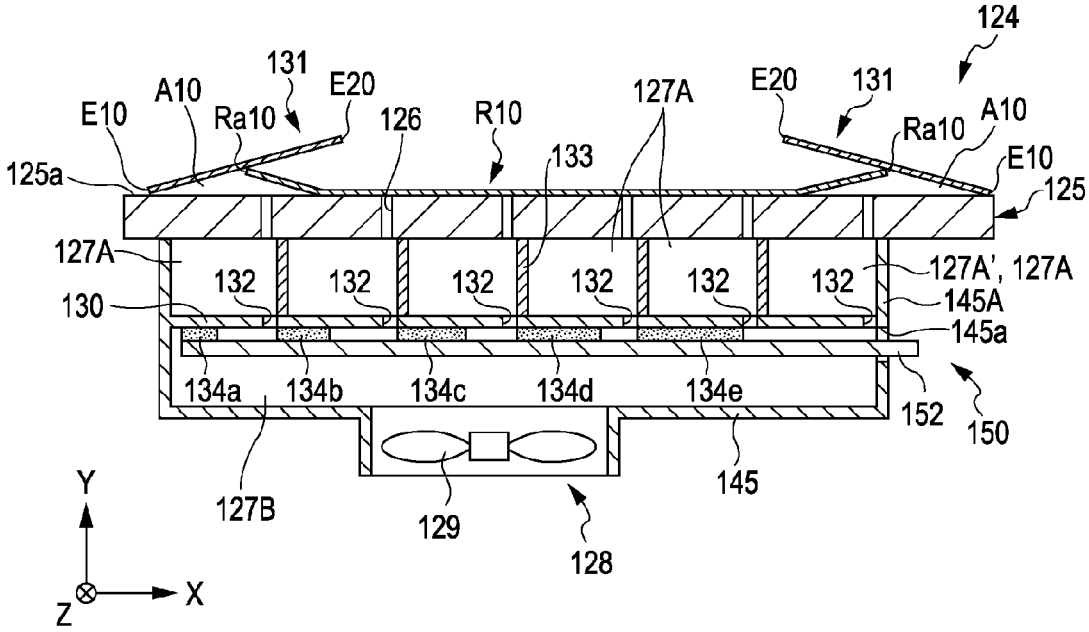
FIG. 12 is a cross-sectional view schematically showing the configurations of a suction mechanism, a shutter mechanism, and a wall section.

FIG. 10 is a side view showing the schematic configuration of an ink jet printer related to the second embodiment. FIG. 11 is a top view showing the schematic configuration of an ink jet printer 100. FIG. 12 is a cross-sectional view schematically showing the configurations of a suction mechanism, a shutter mechanism, and a wall section.

As shown in FIG. 10, the ink jet printer (the recording apparatus) 100 includes a feed section 110, a recording section (the recording process section) 120, and a discharge section 140.

The feed section (the medium transport section) 110 is provided so as to be able to feed rolled paper R10 that is one example of a recording medium (a supported medium) to the recording section 120. Specifically, the feed section 110 has a rolled medium holder 111 and the rolled medium holder 111 holds the rolled paper R10 with a roll shape. Then, a configuration is made such that by rotating the rolled paper R10 with a roll shape, it is possible to feed the rolled paper R10 in a state where the rolled state is released, to the recording section 120 on the downstream side of the transport direction (the direction of the arrow on the Y axis) through a first roller 112.

The recording section 120 is provided so as to be able to carry out recording by discharging ink that is one example of liquid onto the rolled paper R10 sent from the feed section 110.

Specifically, the recording section 120 includes a carriage 121, a recording head 122, a medium support table 124, a curl presser section 501, and the like.

The carriage 121 is provided so as to face the medium support table 124 and be able to move in the transport direction Y of the rolled paper R10 by the power of a carriage motor (not shown) while being guided by a second guide shaft (not shown).

In addition, in FIG. 10, a state is shown where the carriage 121 has retreated further to the upstream side in the transport direction than the medium support table 124.

Further, the recording head 122 is provided on the carriage 121, thereby being provided so as to be able to move together with the carriage 121 in the transport direction Y.

Further, the recording head 122 is configured so as to be able to move relative to the carriage 121 in the width direction X. Specifically, the recording head 122 is provided so as to be able to move in the width direction X by the power of a recording head motor (not shown) while being guided by a second guide shaft (not shown).

In other words, the recording head 122 is configured so as to be able to move in the Y direction (the sub-scanning direction) that is the transport direction and the X direction (the main scanning direction) that is the width direction, in a range which faces the medium support table 124.

Then, recording can be carried out on the rolled paper R10 by discharging ink from a nozzle row 123 provided in the surface facing the medium support table 124 of the recording head 122.

The medium support table (the medium suction and support device) 124 is provided so as to be able to support the rolled paper R10 from the rear surface side of the rolled paper R10. The medium support table 124 includes a platen (the medium support section) 125 having a medium support surface 125*a* (FIG. 11) which supports the rolled paper R10, a pressure chamber forming body 145 which forms a plurality of pressure chambers (the first suction sections) 127A and a pressure chamber (the second suction section) 127B, and a suction mechanism 128 which applies negative pressure to the pressure chambers 127A and 127B.

As shown in FIG. 11, in the platen 125, suction holes (the first suction holes) 126, each of which is formed of a through-hole having, for example, an inner diameter of the order of several mm, are formed over almost the entirety of the medium support surface 125*a* which supports the rolled paper R10. Specifically, the suction holes 126 each having an inner diameter in a range of 2 mm to 3 mm are formed to be arranged in the Y direction (the transport direction of the rolled paper R10) that is the longitudinal direction of the platen 125 and the X direction (the width direction of the rolled paper R10) that is the width direction.

As shown in FIG. 12, the inside of the pressure chamber forming body 145 has a so-called double floor structure which has a wall section 130 disposed spaced apart from and parallel to a bottom portion, and is disposed on the rear surface side of the platen 125 to be also spaced apart from the platen 125. The pressure chamber forming body 145 has the plurality of pressure chambers 127A which is disposed on the rear surface side of the platen 125, and the pressure chamber 127B which is disposed on the rear surface side of the wall section 130, that is the side opposite to the platen 125 with respect to the plurality of pressure chambers 127A. Then, a configuration is made in which the plurality of pressure chambers 127A is stacked on the pressure chamber 127B which is large relative to the pressure chamber 127A.

The respective pressure chambers 127A (six in this embodiment) communicate with the outside through the plurality of suction holes 126 formed in the platen 125. Here, the number of suction holes 126, each of which is opened to each pressure chamber 127A, may be one and may also be the plural. The plurality of pressure chambers 127A is arranged side by side in the short-side direction of the platen 125, that is, a direction (the paper width direction) crossing the transport direction of the rolled paper R10, and the pressure chambers 127A adjacent to each other in the same direction are partitioned by a partition section 133.

Each of a plurality of partition sections 133 (five in this embodiment) is a plate member extending in the long-side direction of the pressure chamber forming body 145 (the transport direction of the rolled paper R10), is provided in an erect manner to connect the platen 125 and the wall section 130 to each other, and is disposed between the suction holes 126 adjacent to each other in the paper width direction among a large number of suction holes 126 formed in the platen 125.

In the wall section 130, a plurality of suction holes (the second suction holes) 132 penetrating the wall section 130 in the thickness direction is formed. The suction holes 132 are formed on a one-to-one basis with each pressure chamber 127A, and each pressure chamber 127A and the pressure chamber 127B communicate with each other through the suction hole 132.

In this embodiment, a hole row L10 composed of the plurality of suction holes 132 arranged in a direction (the short-side direction of the wall section 130) crossing the transport direction of the rolled paper R10 to correspond to the respective pressure chambers 127A is located near the center in the transport direction of the rolled paper R10 (near the center in the longitudinal direction of the wall section 130) and made so as to be able to efficiently apply negative pressure to the respective pressure chambers 127A extending in the same direction.

Each suction hole 132 is a long hole having a given length along the longitudinal direction of the wall section 130 and is formed in the vicinity of each partition section 133. Here, the shapes in a plan view or the number of the suction holes 132 and the position of the hole row L10 in the longitudinal direction of the wall section 130 can be appropriately changed and are not limited to those described above.

Each of the plurality of pressure chambers 127A is a small-sized enclosed space in which a top surface is formed by the platen 125 and a bottom surface is formed by the wall section 130, and the pressure chamber 127B is a large-sized enclosed space in which a top surface is formed by the bottoms of the plurality of pressure chambers 127A, that is, the top surface of the wall section 130. Then, the suction mechanism 128 is connected to the pressure chamber forming body 145 so as to be connected to the bottom of the pressure chamber 127B (the bottom of the pressure chamber forming body 145). In addition, the suction mechanism 128 may also be connected to the pressure chamber forming body 145 so as to be connected to a side wall of the pressure chamber 127B.

In the inside of the pressure chamber forming body 145, a shutter mechanism 150 capable of selectively opening and closing the large number of suction holes 132 formed in the wall section 130 is provided. The configuration or the like of the shutter mechanism 150 will be described later.

The suction mechanism 128 is for suctioning air in the pressure chambers 127A and 127B which are in the state of communicating with each other through the suction holes 132, thereby applying negative pressure to the inside of each space. Specifically, the suction mechanism 128 is configured so as to suction air in the pressure chambers 127A and 127B by an axial-flow fan 129. In this way, external air is suctioned through the large number of suction holes 126 formed in the platen 125, so that the rolled paper R10 placed on the platen 125 is adsorbed to the medium support surface 125*a*.

As shown in FIGS. 11 and 12, the curl presser section 501 is for pressing the side ends Ra10 of the rolled paper R10 placed on the platen 125 toward the medium support surface 125*a*, thereby preventing so-called floating in which the side ends Ra10 of the rolled paper R10 are curled and separated from the platen 125.

Specifically, the curl presser section 501 is provided with a pair of curl presser members 131 each made of a strip-shaped film having pliability and flexibility. Each curl presser member 131 is disposed over all areas in the Y direction (the transport direction of the rolled paper R10) along the Y direction on both end sides in the X direction of the platen 125 (both ends in the width direction of the rolled paper R10).

In addition, the curl presser member 131 has, for example, a thickness of 0.5 mm or less and a width of about 30 mm. Further, as a material thereof, for example, polyimide or the like can be used.

Both ends (end portions in the Y direction) of each curl presser member 131 are respectively connected to curl presser mounting sections 135. Each of the curl presser mounting sections 135 is a member having a length approximately equal to the length in the width direction (the X direction) of the platen 125 and is fixed to a base section (not shown) of the ink jet printer 100 along the width direction at a position spaced apart from an end portion in the longitudinal direction (the Y direction) of the platen 125.

Further, both ends of the curl presser member 131 are respectively connected to the curl presser mounting sections 135 so as to be able to move along the X direction. In this way, each curl presser member 131 is disposed in a parallel fashion in the longitudinal direction (the Y direction) of the platen 125 at an arbitrary position in the width direction (the X direction) of the platen 125 by moving the both ends thereof along the curl presser mounting sections 135.

Therefore, it becomes possible to press both ends in the width direction (the X direction) of the rolled paper R10 placed on the upper surface of the platen 125 over the entire area in the longitudinal direction (the Y direction).

The discharge section 140 shown in FIG. 10 is configured so as to have a take-up roller 141 and wind the rolled paper R10 sent from the recording section 120 on the take-up roller 141.

In addition, the discharge section 140 is sometimes provided with a tensioner which eliminates the flexure of the rolled paper R10 when the rolled paper R10 sent from the recording section 120 is wound by the take-up roller 141, or a drying section which performs a heating and drying treatment on the rolled paper R10 sent from the recording section 120.

Next, the configuration of the shutter mechanism 150 provided in the medium support table 124 will be described in detail.

Figure 13:
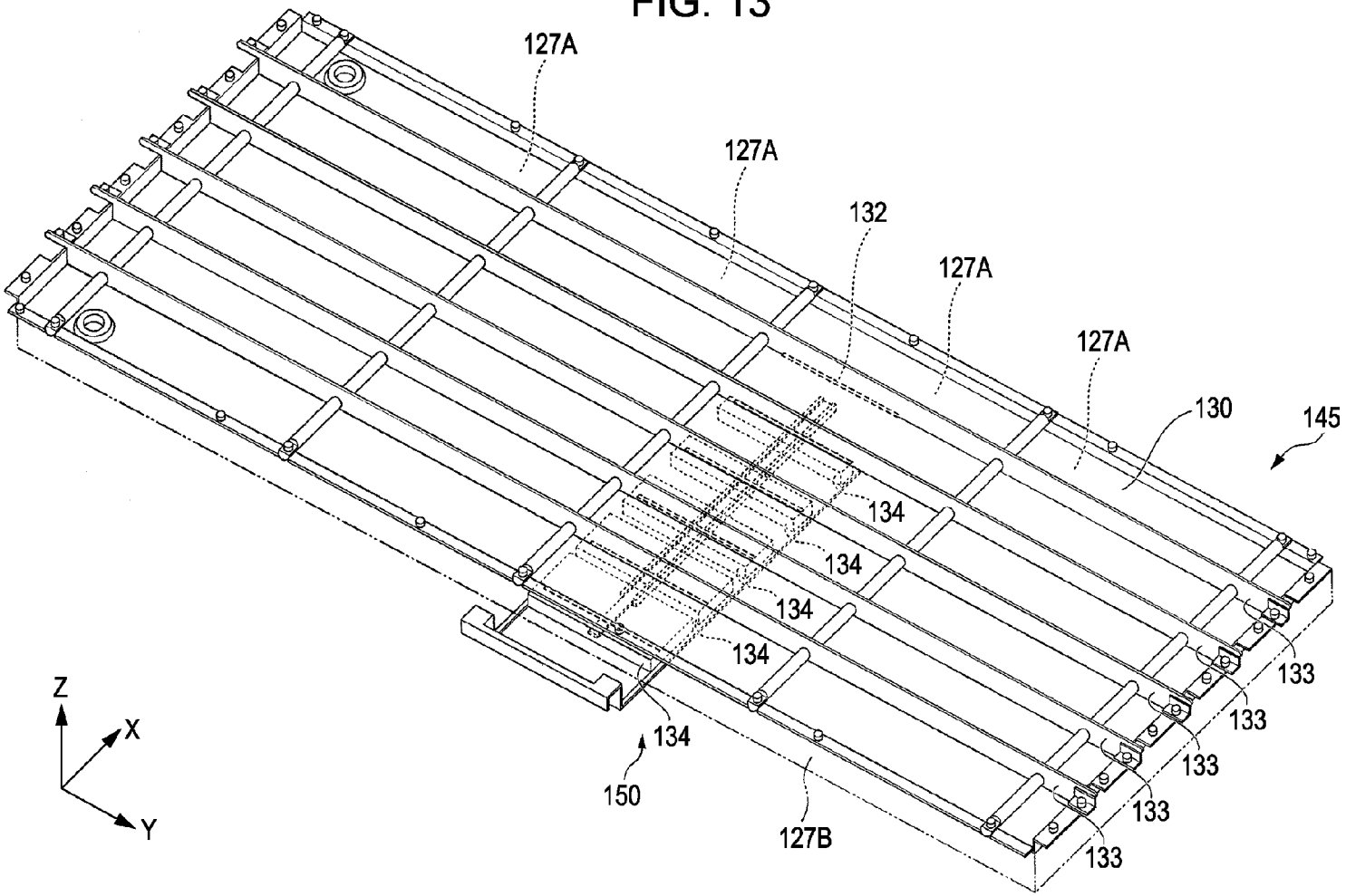
FIG. 13 is a perspective view showing the configurations of the shutter mechanism and the wall section.
Figure 14:
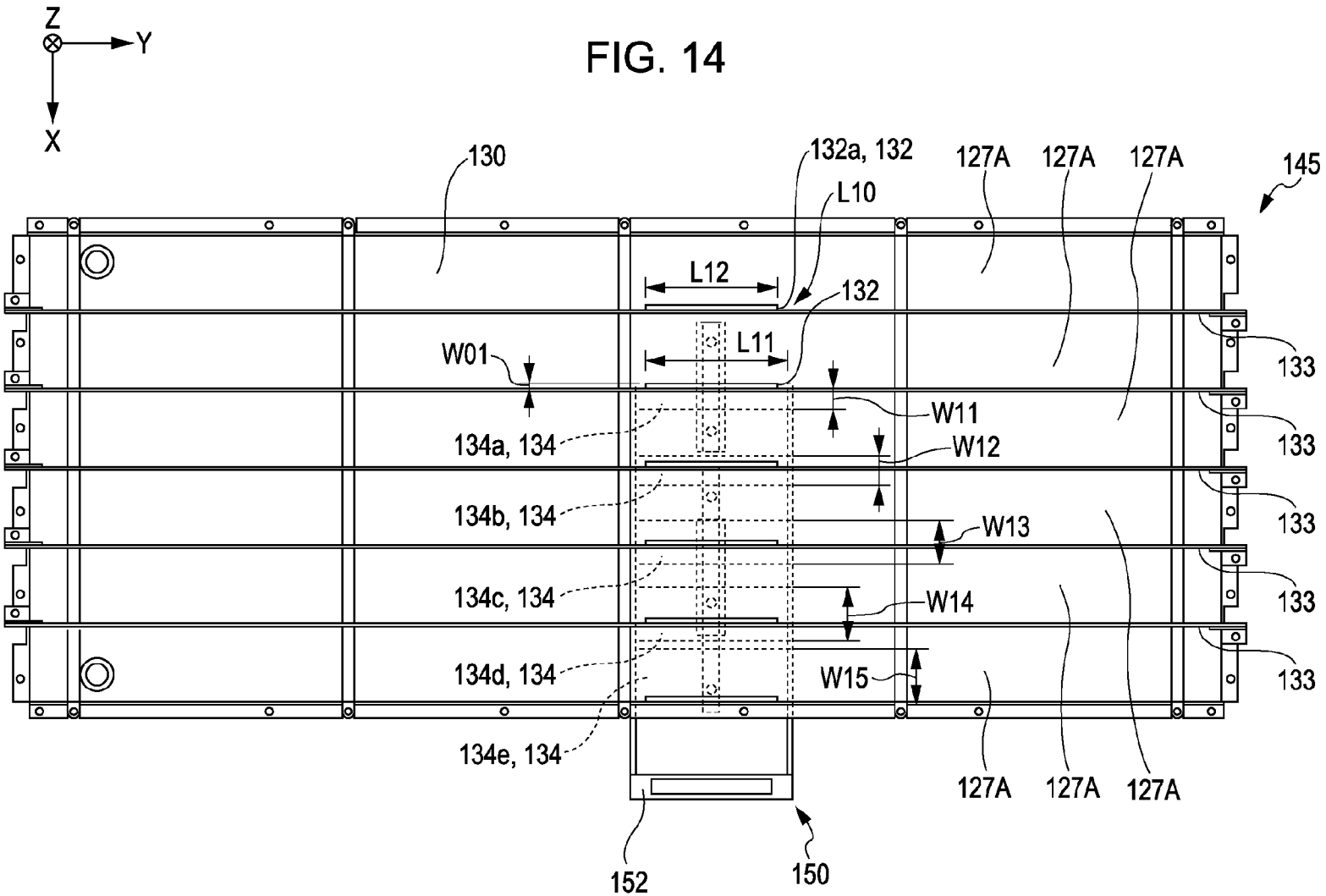
FIG. 14 is a top view schematically showing a positional relationship between the shutter mechanism and the wall section.

FIG. 13 is a perspective view showing the configurations of the shutter mechanism and the wall section, and FIG. 14 is a top view showing a positional relationship between the shutter mechanism and the wall section.

As shown in FIGS. 13 and 14, the shutter mechanism 150 can selectively open and close the large number of suction holes 132 formed in the wall section 130, in accordance with a change in the size (a change in the width dimension) of the rolled paper R10, as described above, and makes a adsorption force selectively act on the large number of suction holes 126 formed in the platen 125.

The shutter mechanism 150 is constituted by a slide plate 152 disposed in a parallel fashion on the rear surface side of the wall section 130, and a plurality of blocking portions 134 capable of selectively blocking the plurality of suction holes 132 provided in the wall section 130.

The slide plate 152 is a plate-like member exhibiting a rectangular shape in a plan view having a length equal to the short-side direction of the platen 125, and the plurality of blocking portions 134 (five in this embodiment) is provided on the surface thereof facing the rear surface of the wall section 130. The plurality of blocking portions 134 are disposed at given intervals so as to correspond to the large number of suction holes 132 formed in the wall section 130. In other words, the blocking portions 134 disposed on the slide plate 152 are disposed in a row so as to overlap the suction holes 132 of the wall section 130 in a plan view.

Here, since it is not necessary to block all the suction holes 132, the blocking portion 134 corresponding to a suction hole 132*a* (132) which is located at the outermost side of the hole row L10 need not be provided. Although the details will be described later, the blocking portion 134 corresponding to the suction hole 132 farthest from the drawing-out direction (direction of parallel movement) of the slide plate 152 need not be provided. In this way, the rolled paper R10 having a width dimension smaller than the greatest width dimension of the rolled paper R10 capable of being handled by the ink jet printer 100 related to this embodiment can be adsorbed.

The slide plate 152 is configured so as to be able to manually or automatically move in a parallel fashion in the X direction (the width direction of each of the platen 125 and the rolled paper R10) in a state where the slide plate 152 is disposed parallel to the wall section 130. Specifically, the slide plate 152 is made so as to be able to move in a parallel fashion and in a stepwise manner at a given interval (pitch) in the +X direction. For example, the slide plate 152 is made so as to be able to move in a parallel fashion and in a stepwise manner at an interval (a pitch) of 6 mm, thereby moving in a parallel fashion to a position of 6 mm, 12 mm, 18 mm, 24 mm, 30 mm, or the like from the initial position shown in FIGS. 12 and 13 toward the X direction.

In this embodiment, since the slide plate 152 is moved in a parallel fashion along the wall section 130, in order to make a load at that time small, it is preferable to set the thickness of the slide plate 152 to be the order of several mm.

Further, it is preferable that the blocking portion 134 has a height (thickness) of the order of several mm and be formed by an elastic member such as rubber, sponge which it is difficult for air to pass through, a resin material, or the like. As will be described later, by moving the slide plate 152 in a parallel fashion, thereby disposing a corresponding blocking portion 134 on an arbitrary suction hole 132 so as to face the suction hole 132, it is possible to block the suction holes 132.

The slide plate 152 is incorporated into the pressure chamber 127B in a state where the blocking portions 134 are elastically deformed (compressively deformed) toward the wall section 130 side. For example, in the case of the blocking portion 134 having a thickness of 12 mm, the blocking portion 134 enters a state where 50% of the thickness thereof is crushed.

In addition, a major portion of the slide plate 152 is almost accommodated in the pressure chamber 127B. However, in order for the slide plate 152 to move in a parallel fashion in the X direction along the wall section 130, an opening 145*a* which make a portion (an end portion) of the slide plate 152 be inserted therein and pass therethrough is provided in a side wall 145A of the pressure chamber forming body 145, so that one end portion of the slide plate 152 is disposed so as to protrude outside the pressure chamber 127B (the pressure chamber forming body 145).

Specifically, in the opening 145*a* provided in the side wall 145A of the pressure chamber forming body 145, an airtight mechanism (not shown) is provided such that air is not leaked. Then, a configuration is made such that the slide plate 152 can be moved in a parallel fashion toward the +X direction by inserting the slide plate 152 from the opening 145*a* into the pressure chamber 127B and drawing out the slide plate 152 from the opening 145*a*.

Further, each of the plurality of blocking portions 134 is formed in a rectangular shape in a plan view, in which a short-side direction thereof follows the X direction, and is formed to have a size capable of covering the suction hole 132. In this embodiment, the lengths (the widths) of the respective blocking portions 134 following the direction of movement (the X direction) of the slide plate 152 are different in accordance with the disposition positions of the blocking portions 134 in the X direction (the width direction of each of the platen 125 and the rolled paper R10).

Specifically, a width W11 of a blocking portion 134*a* (134) disposed on one side (the −X direction side) in the direction of movement of the slide plate 152 is formed longer than a width W01 of the suction hole 132. A blocking portion 134*b* adjacent to the blocking portion 134*a* in the X direction has a width in the +X direction longer than the width W11 of the blocking portion 134*a*. Further, a blocking portion 134*c*, a blocking portion 134*d*, and a blocking portion 134*e* along the +X direction are formed such that only the width dimensions thereof become longer in a stepwise manner as it goes in the +X direction, and the widths of the blocking portions 134*a* to 134*e* have a relationship W11<W12<W13<W14<W15.

On the other hand, lengths L11 in the long-side directions (the Y direction) of the plurality of blocking portions 134 are constant and formed so as to become longer than a length L12 of the suction hole 132. In this manner, a configuration is made in which the suction hole 132 corresponding to each blocking portion 134 can be blocked by each blocking portion 134.

Further, a chamfering treatment is carried out on an inner peripheral edge of each suction hole 132. Since in particular, the inner peripheral edge on the pressure chamber 127B side of the suction hole 132 comes into contact with the blocking portion 134 and is rubbed against the blocking portion 134, it is preferable to carry out various low-friction treatments other than the chamfering treatment.

In addition, the number, the shapes, or the like of the suction holes 132 or the blocking portions 134 is not limited to that shown and can be appropriately changed.

Next, an operation of the shutter mechanism 150 having the above-described configuration will be described.

In a state shown in FIG. 12, that is, the initial state of the shutter mechanism 150 (the initial position of the slide plate 152), the plurality of suction holes 132 formed in the wall section 130 all remain opened, so that the pressure chambers 127A and 127B communicate with each other through these suction holes 132.

In this initial state, the suction mechanism 128 connected to the pressure chamber 127B of the medium support table 124 is driven, so that the axial-flow fan 129 is rotated, thereby applying negative pressure to the inside of the pressure chamber 127B. Then, the insides of the pressure chambers 127A attain negative pressure states through the respective suction holes 132 of the wall section 130, so that air (external air) on the medium support surface 125*a* of the platen 125 is suctioned through all the suction holes 126 formed in the platen 125. In this way, the rolled paper R10 can be adsorbed to the medium support surface 125*a*.

In more detail, an operation is performed as shown in the following.

Figure 15A:
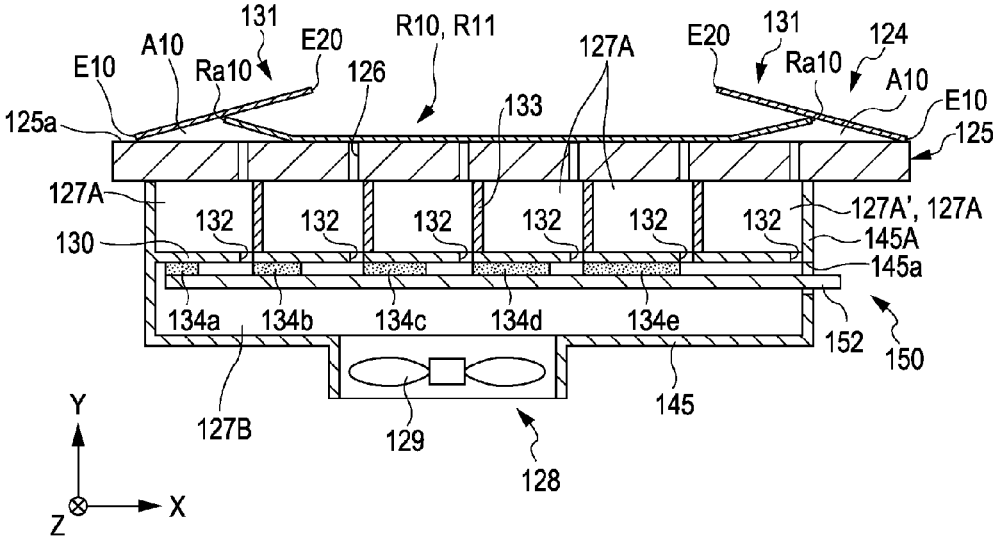
FIGS. 15A and 15B are cross-sectional views showing an action when the suction mechanism of a medium support table is driven.
Figure 15B:
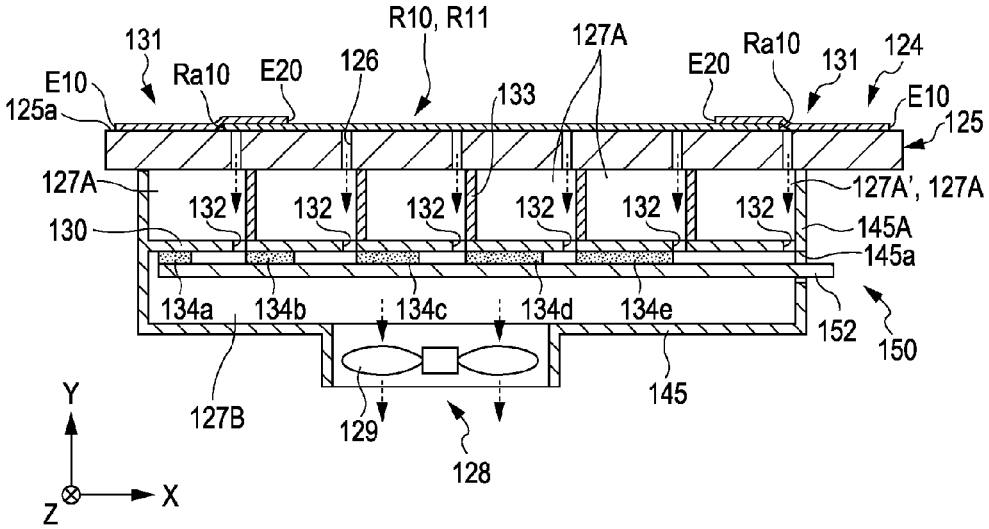

FIGS. 15A and 15B are cross-sectional views showing an action when the suction mechanism of the medium support table 124 is driven.

In addition, in FIGS. 14, 15A, and 15B, a case is shown where the width dimension (the length in the X direction) of rolled paper (the recording medium) R11 is approximately equal to the width dimension of the platen 125.

As shown in FIG. 15A, in a state where the rolled paper R10 has been sent onto the platen 125, an operator fits the positions of the curl presser members 131 in the X direction to positions facing the side ends Ra10 of the rolled paper R11 and places each curl presser member 131 on each side end Ra10 of the rolled paper R11.

At this time, an outer end E10 of each curl presser member 131 is disposed so as to be located further toward the outside than the side end Ra10 of the rolled paper R11 and is brought into contact with the platen 125. On the other hand, an inner end E20 of each curl presser member 131 is disposed so as to be located further toward the inside than the side end Ra10 of the rolled paper R10 and is brought into contact with the side end Ra10 of the rolled paper R11.

Since a force pressing the rolled paper R11 to the platen 125 side acts on the pair of curl presser members 131, it is possible to bring the outer ends E10 of the pair of curl presser members 131 into at least linear contact with the platen 125 and also to bring the inner ends E20 of the pair of curl presser members 131 into contact with the side ends Ra10 of the rolled paper R10.

Then, as described above, the plurality of suction holes 126 are provided at least in areas facing the side ends Ra10 of the rolled paper R11 and the curl presser members 131 in the medium support surface 125*a* of the platen 125. Therefore, by driving the suction mechanism 128, air in spaces A10 each surrounded by the platen 125, the rolled paper R11, and the curl presser member 131 is suctioned through the suction holes 126.

Therefore, as shown in FIG. 15B, the rolled paper R11 and the pair of curl presser members 131 enter states where they come into close contact with the platen 125 and enter states where they are adsorbed to the medium support table 124. In this way, the rolled paper R11 can be adsorbed in a planar state along the medium support surface 125*a* of the platen 125.

Next, a case will be described where in place of the rolled paper R11, rolled paper (the recording medium) R12 having a width dimension narrower than that of the rolled paper R11 is adsorbed to the medium support table 124.

Figure 16A:
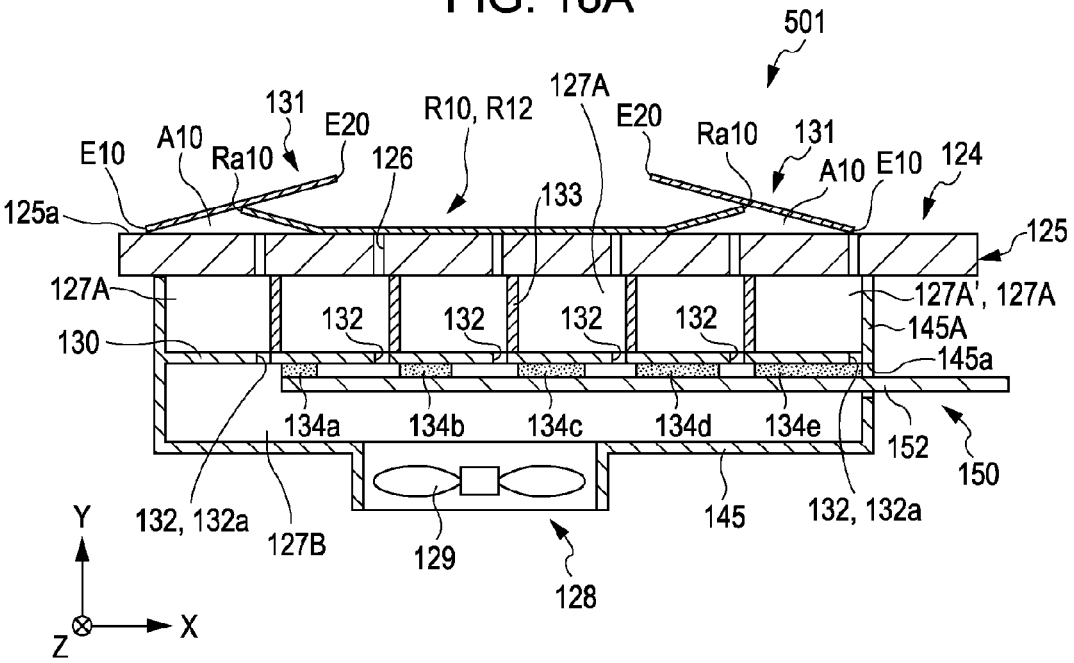
FIG. 16A is a schematic cross-sectional view showing the initial position of a slide plate.
Figure 16B:
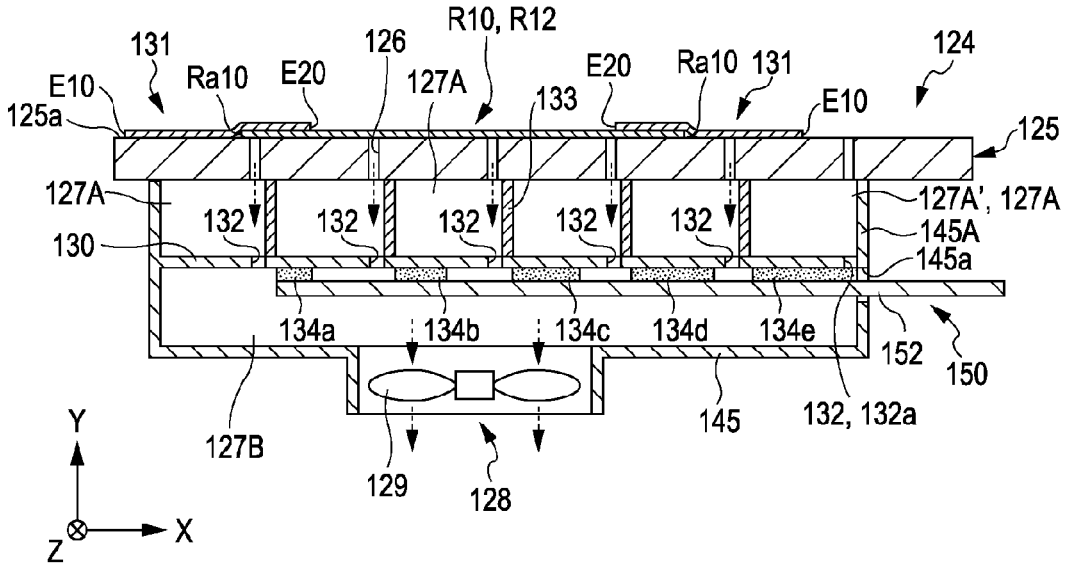
FIG. 16B is a schematic cross-sectional view showing a case where the slide plate has been moved by one step from the initial position toward the X direction.

FIG. 16A is a schematic cross-sectional view showing the initial position of the slide plate 152, and FIG. 16B is a schematic cross-sectional view showing a case where the slide plate 152 has been moved by one step from the initial position toward the X direction.

For example, the width dimension of the rolled paper R12 is set to be narrower than that of the rolled paper R11 by an amount corresponding to a disposition pitch (one pitch) in the X direction of the suction hole 126. When placing the rolled paper R12 on the medium support surface 125*a* of the platen 125, the rolled paper R12 is placed by so-called one-side matching (based on the end portion).

In a case where the width dimension of the rolled paper R12 placed on the platen 125 is narrower than that of the rolled paper R11, in advance of driving the suction mechanism 128, an operator moves the slide plate 152 in a parallel fashion from the initial position (FIG. 14) toward the +X direction. In the case of the rolled paper R12, since the width dimension thereof is narrower than that of the rolled paper R11 by an amount corresponding to a disposition pitch (one pitch) in the X direction of the suction hole 126, the slide plate 152 is moved by one step from the initial position toward the +X direction.

As described above, in the initial position of the shutter mechanism 150 (the initial position of the slide plate 152), all the suction holes 132 provided in the wall section 130 are in opened states. If the slide plate 152 is moved by a given distance from the initial position toward the +X direction, as shown in FIG. 16A, among the plurality of blocking portions 134 provided on the slide plate 152, the blocking portion 134*e* faces the suction hole 132*a* which is located furthest in the direction of movement (the X direction) of the slide plate 152 and a portion of the blocking portion 134*e* penetrates into the suction hole 132*a*, so that an opening is blocked, whereby a pressure chamber 127A' (127A) is cut off from the pressure chamber 127B. Further, the plurality of suction holes 132 which are located in areas where the rolled paper R12 is present remain opened, so that each pressure chamber 127A and the pressure chamber 127B communicate with each other through the five suction holes 132 which are in opened states.

Further, at the same time as the movement of the slide plate 152 in the +X direction, one of the curl presser members 131 is moved in the −X direction, thereby being fitted to a position facing the side end Ra10 of the rolled paper R12.

Then, by driving the suction mechanism 128 in the above state, the rolled paper R12 enters a state where it is adsorbed to the medium support surface 125*a* of the platen 125 as shown in FIG. 16B.

At this time, a state is created where the rolled paper R12 and the curl presser member 131 are not present above the suction hole 126 disposed furthest in the +X direction among the large number of suction holes 126 formed in the platen 125. For this reason, in an existing medium support table 124, if the suction mechanism 128 is driven, since external air is always suctioned from the suction hole 126 which is located in an area where the rolled paper R12 is not present, the adsorption forces of the other suction holes 126 which are located in areas where the rolled paper R12 is present are reduced, so that there is a case where it is not possible to adsorb the rolled paper R12 on the platen 125.

In contrast, in the medium support table 124 in this embodiment, since the outermost (in the +X direction) suction hole 132*a* is blocked by the blocking portion 134*e* by moving the slide plate 152 in the +X direction, suctioning of external air through the corresponding suction hole 126 corresponding to the blocked suction hole 132*a* is mostly prevented.

Therefore, the adsorption forces of the plurality of other suction holes 126 which are located in areas where the rolled paper R12 is present are not reduced. In this way, even in the case of the rolled paper R12 having a width dimension narrower than that of the rolled paper R11, the rolled paper R12 can be adsorbed to the medium support surface 125*a* of the platen 125 by an adsorption force approximately equal to that in the case of the rolled paper R11.

Further, in a case where rolled paper or the like, in which a width dimension is narrower (length in the X direction is shorter) than those of the rolled paper R11 and R12, is adsorbed to the platen 125, an operator moves the slide plate 152 and the curl presser members 131 in a parallel fashion toward the X direction in accordance with the width dimension of the rolled paper.

In this manner, even in the case of adsorbing the rolled paper R10 (R12) having a different width dimension, by blocking the suction hole 132 which is located in an area where the rolled paper R10 is not present, it is possible to maintain a adsorption force approximately equal to that in the case of the rolled paper R11 and efficiently adsorb the rolled paper R12 in place on the medium support surface 125*a* of the platen 125.

As described above, according to the ink jet printer 100 related to this embodiment, in a state where all the suction holes 132 of the wall section 130 provided on the rear surface side of the platen 125 and disposed between the plurality of pressure chambers 127A and the corresponding pressure chamber 127B are opened, external air is suctioned from all the suction holes 126, so that the rolled paper R11 can be adsorbed.

Then, in a case where the rolled paper is replaced with rolled paper (for example, the rolled paper R12) having a different width dimension, by moving the slide plate 152 in a parallel fashion with respect to the wall section 130, the suction hole 132 corresponding to the suction hole 126 on which the rolled paper R12 is not placed is selectively blocked by the blocking portion 134, and suctioning is performed in this state. In this way, external air is suctioned from the suction holes 126 corresponding to an area where the rolled paper R12 is present, so that the rolled paper R12 can be adsorbed.

For example, in a case where the number of suction mechanisms 128 is one, if an area where a adsorption force is generated is not controlled in accordance with the width dimension of the rolled paper R10, a problem arises in that suction power to the rolled paper R12 is reduced.

In contrast, according to the configuration of this embodiment, by selectively blocking the suction hole 132 which is located in an area where the rolled paper R12 is not present, it becomes no longer possible to suction air near the platen 125 through the corresponding suction hole 126. For this reason, it is possible to make suction power effectively act on the suction holes 126 which are located in areas where the rolled paper R12 is present. Therefore, since suction power to the rolled paper R12 can be sufficiently obtained, even the rolled paper R12 having a different width dimension can be reliably adsorbed on the medium support surface 125*a*.

Further, the size in a plan view of the slide plate 152 is made to be significantly smaller than that of the platen 125. For this reason, even in a configuration in which the slide plate 152 is disposed on the rear surface side of the wall section 130, the slide plate 152 is not easily bent by its own weight, so that it is possible to bring the blocking portions 134 into close contact with the wall section 130. For this reason, it is easy to secure the blocking property of the blocking portion 134 with respect to the suction hole 132, thereby preventing air leakage from the suction hole 132 to be blocked. In this way, the suction holes 132 provided in the wall section 130 are selectively blocked by the blocking portions 134, so that the rolled paper R10 can be adsorbed without reducing functionality and operability as the shutter mechanism 150.

Further, since the direction of parallel movement of the slide plate 152 corresponds with the width direction of the rolled paper R10, it is possible to selectively open and close the suction holes 132 in accordance with a change in the width dimension of the rolled paper R10. In other words, since the lengths of the plurality of blocking portions 134 (134*a* to 134*e*) arranged in the direction of movement of the slide plate 152 are made to be sequentially different in accordance with the disposition positions thereof in the direction of movement of the slide plate 152, it is possible to selectively open and close the plurality of suction holes 132 in a stepwise manner in accordance with the amount of parallel movement of the slide plate 152. Accordingly, it becomes possible to variably control suction amount (an output) by the suction mechanism 128 in accordance with the width dimension of the rolled paper R10.

Further, by making the extending lengths of the blocking portions 134 differ in a stepwise manner along the course of movement of the slide plate 152, it is possible to minimize the movement distance of the slide plate 152. For this reason, it is also possible to minimize installation area of the apparatus.

Further, by applying treatments to reduce friction against the blocking portion 134 of the slide plate 152, such as chamfering working on the inner circumferential surface of the suction hole 132, it is possible to suppress air leakage at the time of blocking of the suction hole 132 over a long period of time.

Further, a chemical treatment may also be carried out on the surface of the blocking portion 134 or the upper surface of the wall section 130 so as to reduce frictional resistance thereof.

Further, a configuration is also acceptable in which a single suction hole 126 communicates with a single pressure chamber 127A, and a configuration may also be made in which a plurality of suction holes 126 communicates with a single pressure chamber 127A.

Further, the slide plate 152 is fabricated by performing sheet-metal working on a thin metal plate.

The slide plate 152 in this embodiment is configured to be small compared to that in the past and not to be easily bent. Further, since each blocking portion 134 is in a state where it is compressed to about half its thickness before it was incorporated into the pressure chamber forming body 145, when the blocking portion 134 is disposed to face the suction hole 132, the blocking portions 134 elastically recover sufficiently such that a portion thereof penetrates into the suction hole 132, whereby the suction hole 132 is blocked.

For this reason, it can be said that even if the flatness of the slide plate 152 is low, influence on the blocking effect is small. Therefore, according to the configuration in this embodiment, a problem of the occurrence of air leakage due to working accuracy of a sheet metal does not arise easily.

Third Embodiment

Next, the configuration of a recording apparatus related to a third embodiment will be described with a focus on the configuration of a shutter mechanism 160.

In the previous embodiment, the suction holes 132 are provided on a one-to-one basis with each pressure chamber 127A. However, in this embodiment, a plurality of suction holes 132 is provided with respect to a single pressure chamber 127A and the shutter mechanism 160 having a plurality of slide plates 152 in accordance with an increase in the number of suction holes 132 is provided.

Figure 17:
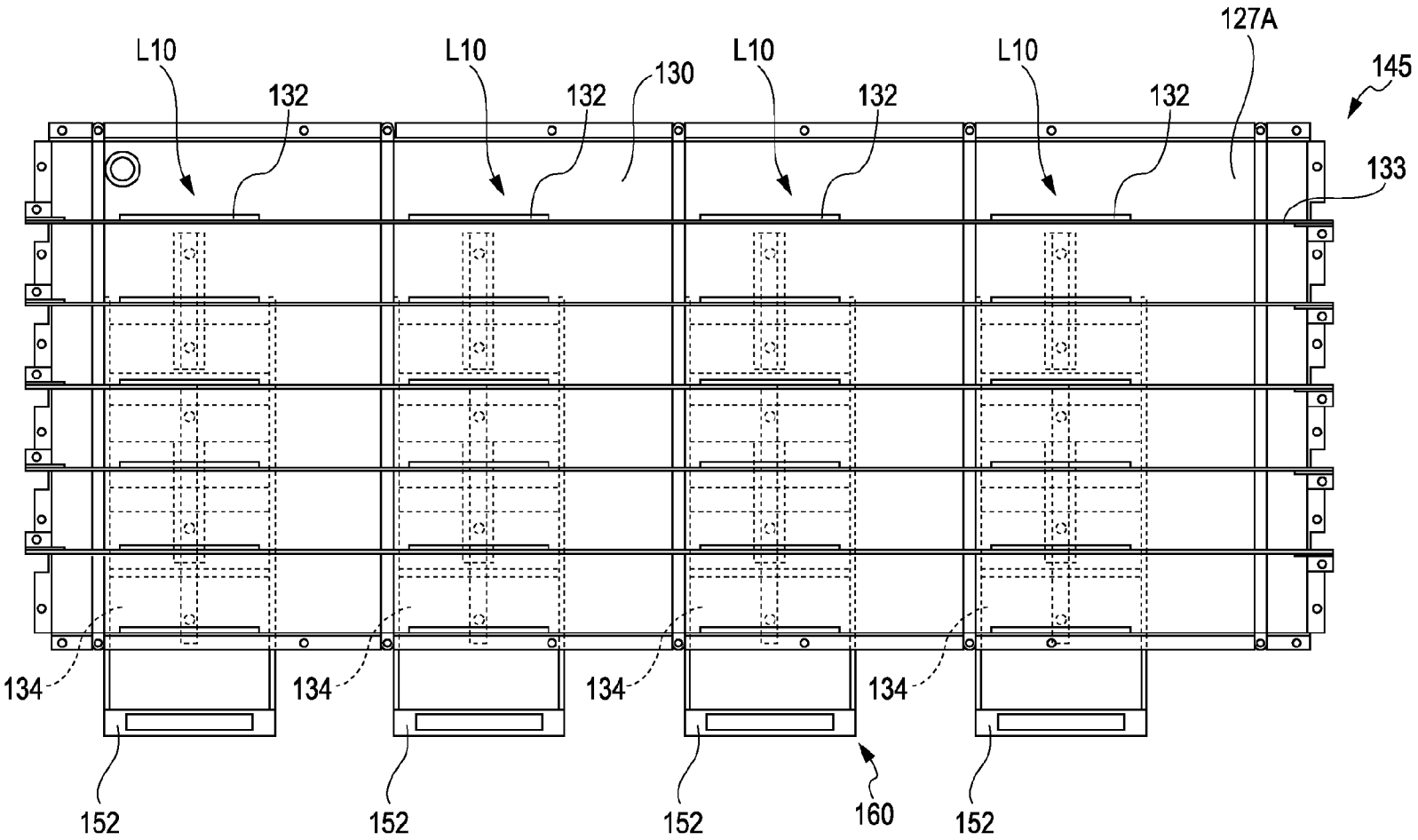
FIG. 17 is a plan view showing the schematic configuration of a shutter mechanism related to a third embodiment.

FIG. 17 is a plan view showing the schematic configuration of the shutter mechanism 160.

As shown in FIG. 17, in the wall section 130 in this embodiment, a plurality of hole rows L10 each composed of the plurality of suction holes 132 is formed along the longitudinal direction of the wall section 130. Although in this embodiment, four hole rows L10 are provided, it is not limited thereto. Further, by taking a configuration in which the slide plate 152 corresponding to each hole row L10 is provided in a plurality (four) on the rear surface side of the wall section 130 and the slide plates 152 are partially connected to each other by connection members (not shown), it is possible to simultaneously move the respective slide plates 152 in a slide direction. For example, a configuration is also acceptable in which side ends of the slide plates 152, which protrude from the pressure chamber forming body 145 to the outside, are connected to each other.

In this manner, since increasing the number of suction holes 132 communicating with a single pressure chamber 127 allows the suction mechanism 128 to quickly apply negative pressure to the inside of each pressure chamber 127, it is possible to start a printing process directly after the rolled paper R10 placed on the platen 125 is rapidly adsorbed. Accordingly, printing process time can be shortened.

Further, since the side portions of the rolled paper R10 placed on the medium support surface 125*a* of the platen 125 can be adsorbed over a wide range along the transport direction, it is possible to keep a printing target area of the rolled paper R10 in a favorable position. In this way, it is possible to improve printing accuracy.

In addition, the number of axial-flow fans 129 of the suction mechanism 128 is not limited to one and a plurality of axial-flow fans may also be provided.

Further, in the second and third embodiments described above, the rolled paper R10 has been given and described as one example of the recording medium. However, single sheet paper or a film material is also acceptable. Further, an ink jet printer has been given and described as an example of the recording apparatus. However, it is not limited to an ink jet printer and an apparatus such as a copying machine or a facsimile machine is also acceptable.

Preferred embodiments related to the invention have been described above with reference to the accompanying drawings by using the first to third embodiments. However, it goes without saying that the invention is not limited to such examples. It will be apparent to those skilled in the art that various changed examples or modification examples can be contemplated within the scope of the technical ideas stated in the appended claims, and it is to be understood that these examples naturally also belong to the technical scope of the invention.

Further, in the first to third embodiments described above, an ink jet printer (a liquid ejecting apparatus) which ejects liquid such as ink has been given and described as an example of the recording apparatus. However, it is possible to apply the invention to a liquid ejecting apparatus which ejects or discharges liquid other than ink. Liquid that a liquid ejecting apparatus can eject includes a liquid state in which particles of functional materials are dispersed or dissolved, or a gel-like fluid state.

Further, in the first to third embodiments described above, as liquid which is ejected from the recording apparatus (the liquid ejecting apparatus), not only ink, but also liquid corresponding to a specific use can be applied. By providing an ejecting head capable of ejecting liquid corresponding to a specific use in a liquid ejecting apparatus and then ejecting the liquid corresponding to a specific use from the ejecting head, thereby attaching the liquid to a given object, a given device can be manufactured. As the liquid ejecting apparatus, for example, a liquid ejecting apparatus which ejects liquid (a liquid body) in which a material such as an electrode material or a color material which is used for the manufacturing or the like of a liquid crystal display, an EL (electroluminescence) display, and a field emission display (FED) is dispersed (dissolved) in a given dispersion medium (solvent) can be applied.

Further, as the liquid ejecting apparatus, a liquid ejecting apparatus which ejects a biological organic matter that is used for the manufacturing of a biochip or a liquid ejecting apparatus which is used as a precision pipette and ejects liquid that is a sample is also acceptable.

Further, a liquid ejecting apparatus which ejects lubricant to a precision machine such as a timepiece or a camera by a pin point, a liquid ejecting apparatus which ejects transparent resin solution such as ultraviolet curing resin onto a substrate in order to form a hemispherical micro-lens (an optical lens) or the like which is used in an optical communication element or the like, a liquid ejecting apparatus which ejects etching solution such as acid or alkali in order to etch a substrate or the like, and a fluid body ejecting apparatus which ejects gel are also acceptable. Then, the invention can be applied to any type of liquid ejecting apparatus among these apparatuses.

What is claimed is:

1. A recording apparatus comprising:

a medium support section in which a plurality of first suction holes passing through from a medium support surface which supports a recording medium to a rear surface is formed;

a recording process section which carries out a recording process on the recording medium;

a plurality of first suction sections which is provided on the rear surface side and communicates with the plurality of first suction holes;

a second suction section which is disposed on the side opposite to the medium support section with respect to the plurality of first suction sections;

a wall section which is disposed between the first suction sections and the second suction section and in which a plurality of second suction holes each making each of the first suction sections and the second suction section communicate with each other is formed;

a suction mechanism which suctions the recording medium disposed on the medium support surface through the first suction holes and the second suction holes; and a slide member which is disposed on the wall section, is movable in a parallel fashion along the wall section, and is provided with a plurality of blocking portions having different lengths in a direction of parallel movement and capable of selectively blocking the plurality of second suction holes, wherein the slide member selectively blocks the second suction holes based on a size of the recording medium.

2. The recording apparatus according to claim 1, wherein the slide member is disposed on the wall section on the first suction section side, is movable in a parallel fashion along the wall section, and is provided with the plurality of blocking portions having different lengths in the direction of parallel movement and capable of selectively blocking the plurality of second suction holes.

3. The recording apparatus according to claim 1, wherein the slide member has an area smaller than that of the medium support surface, is disposed parallel to the wall section on the rear surface side of the wall section, is movable in a parallel fashion along a direction crossing a transport direction of the recording medium, and is provided with the blocking portions having different lengths in the direction of parallel movement and capable of selectively blocking the plurality of second suction holes.

4. The recording apparatus according to claim 2, wherein the plurality of blocking portions have sequentially different lengths in accordance with positions in the direction of parallel movement.

5. The recording apparatus according to claim 2, wherein a partition section which is disposed between the medium support section and the wall section and partitions the first suction sections adjacent to each other in a transport direction of the recording medium is provided in a plurality.

6. The recording apparatus according to claim 2, wherein a biasing section which biases the blocking portion to the wall section side is provided.

7. The recording apparatus according to claim 2, wherein at least the blocking portion is formed by an elastic member.

8. The recording apparatus according to claim 3, wherein the blocking portion is incorporated in a state where the blocking portion is elastically deformed toward the wall section.

9. The recording apparatus according to claim 3, wherein a row composed of the plurality of second suction holes arranged in the direction crossing the transport direction of the recording medium is provided in a plurality in the transport direction, and the slide member is provided for each row.

* * * * *